US009738069B2

(12) United States Patent
Oikawa et al.

(10) Patent No.: US 9,738,069 B2
(45) Date of Patent: Aug. 22, 2017

(54) INKJET PRINTING APPARATUS AND INKJET PRINTING METHOD

(71) Applicant: CANON KABUSHIKI KAISHA, Tokyo (JP)

(72) Inventors: Yuhei Oikawa, Yokohama (JP); Taku Yokozawa, Yokohama (JP); Hiroaki Shirakawa, Kawasaki (JP); Mitsutoshi Nagamura, Tokyo (JP); Hiroshi Taira, Fuchu (JP); Yosuke Ishii, Kawasaki (JP); Satoshi Azuma, Kawasaki (JP); Hiroaki Komatsu, Fuji (JP); Kazuhiko Sato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/163,167

(22) Filed: May 24, 2016

(65) Prior Publication Data

US 2016/0347057 A1 Dec. 1, 2016

(30) Foreign Application Priority Data

May 29, 2015 (JP) ..... 2015-110378

(51) Int. Cl.
*B41J 2/045* (2006.01)

(52) U.S. Cl.
CPC ..... *B41J 2/04588* (2013.01); *B41J 2/0456* (2013.01); *B41J 2/0458* (2013.01); *B41J 2/04506* (2013.01); *B41J 2/04563* (2013.01); *B41J 2/04573* (2013.01); *B41J 2/04591* (2013.01); *B41J 2/04598* (2013.01); *B41J 2/04586* (2013.01)

(58) Field of Classification Search
CPC .. B41J 2/04588; B41J 2/04563; B41J 2/0456; B41J 2/04598; B41J 2/04586; B41J 2/04591; B41J 2/04506; B41J 2/0458; B41J 2/04573
See application file for complete search history.

(56) References Cited

U.S. PATENT DOCUMENTS 6,511,145 B1 * 1/2003 Tsuboi ..... B41J 2/04528 347/11

FOREIGN PATENT DOCUMENTS

JP H05-031905 A 2/1993

* cited by examiner

*Primary Examiner* — Manish S Shah
*Assistant Examiner* — Yaovi M Ameh
(74) *Attorney, Agent, or Firm* — Canon U.S.A., Inc. IP Division

(57) ABSTRACT

A driving pulse to be applied to a plurality of print elements in a print element array is decided based on the deviation of the discharge amount from the print elements.

12 Claims, 25 Drawing Sheets

FIG. 7A

| DRIVING PULSE No. | DRIVING PULSE WAVEFORM |
|---|---|
| No.6' | 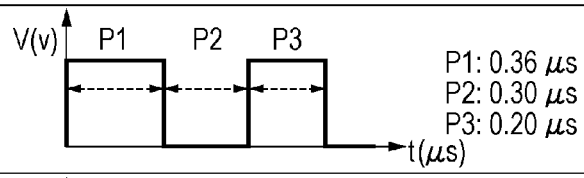  P1: 0.36 μs<br>P2: 0.30 μs<br>P3: 0.20 μs |
| No.5' | 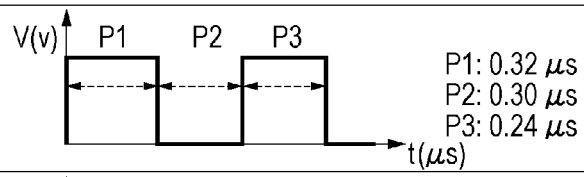  P1: 0.32 μs<br>P2: 0.30 μs<br>P3: 0.24 μs |
| No.4' | 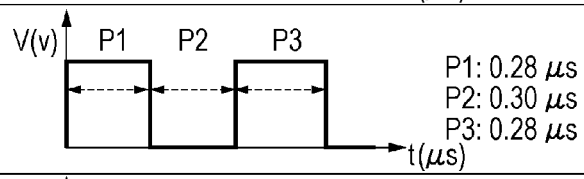  P1: 0.28 μs<br>P2: 0.30 μs<br>P3: 0.28 μs |
| No.3' | 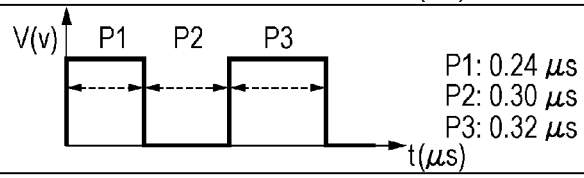  P1: 0.24 μs<br>P2: 0.30 μs<br>P3: 0.32 μs |
| No.2' | 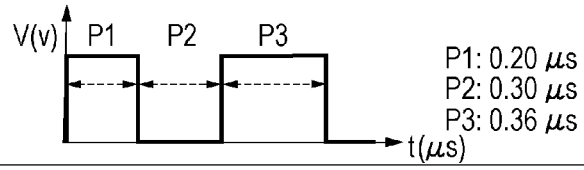  P1: 0.20 μs<br>P2: 0.30 μs<br>P3: 0.36 μs |
| No.1' | 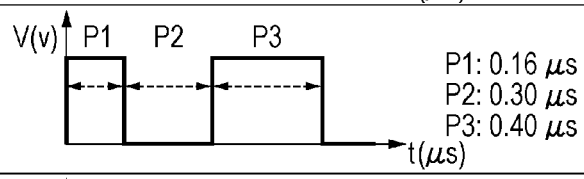  P1: 0.16 μs<br>P2: 0.30 μs<br>P3: 0.40 μs |
| No.0' | 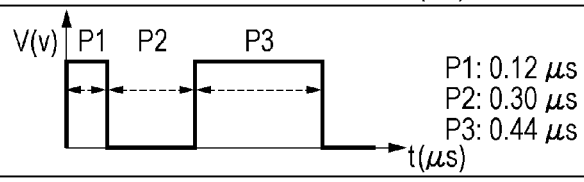  P1: 0.12 μs<br>P2: 0.30 μs<br>P3: 0.44 μs |

FIG. 7B

| INK TEMPERATURE | LOWER THAN 20°C | 20°C TO LOWER THAN 30°C | 30°C TO LOWER THAN 40°C | 40°C TO LOWER THAN 50°C | 50°C TO LOWER THAN 60°C | 60°C TO LOWER THAN 70°C | 70°C OR HIGHER |
|---|---|---|---|---|---|---|---|
| DRIVING PULSE | No.6' | No.5' | No.4' | No.3' | No.2' | No.1' | No.0' |

FIG. 10A

| DRIVING PULSE No. | DRIVING PULSE WAVEFORM | DRIVING PULSE No. | DRIVING PULSE WAVEFORM |
|---|---|---|---|
| No.6 | V(v) P1 P2 P3 t(μs) P1: 0.24 μs P2: 0.30 μs P3: 0.32 μs | No.12 | V(v) P1 P2 P3 t(μs) P1: 0.48 μs P2: 0.30 μs P3: 0.08 μs |
| No.5 | V(v) P1 P2 P3 t(μs) P1: 0.20 μs P2: 0.30 μs P3: 0.36 μs | No.11 | V(v) P1 P2 P3 t(μs) P1: 0.44 μs P2: 0.30 μs P3: 0.12 μs |
| No.4 | V(v) P1 P2 P3 t(μs) P1: 0.16 μs P2: 0.30 μs P3: 0.40 μs | No.10 | V(v) P1 P2 P3 t(μs) P1: 0.40 μs P2: 0.30 μs P3: 0.16 μs |
| No.3 | V(v) P1 P2 P3 t(μs) P1: 0.12 μs P2: 0.30 μs P3: 0.44 μs | No.9 | V(v) P1 P2 P3 t(μs) P1: 0.36 μs P2: 0.30 μs P3: 0.20 μs |
| No.2 | V(v) P1 P2 P3 t(μs) P1: 0.08 μs P2: 0.30 μs P3: 0.48 μs | No.8 | V(v) P1 P2 P3 t(μs) P1: 0.32 μs P2: 0.30 μs P3: 0.24 μs |
| No.1 | V(v) P1 P2 P3 t(μs) P1: 0.04 μs P2: 0.30 μs P3: 0.52 μs | No.7 | V(v) P1 P2 P3 t(μs) P1: 0.28 μs P2: 0.30 μs P3: 0.28 μs |
| No.0 | V(v) P3 t(μs) P1: 0 μs P2: 0 μs P3: 0.56 μs | | |

FIG. 10B

| INK TEMPERATURE | LOWER THAN 20°C | 20°C TO LOWER THAN 30°C | 30°C TO LOWER THAN 40°C | 40°C TO LOWER THAN 50°C | 50°C TO LOWER THAN 60°C | 60°C TO LOWER THAN 70°C | 70°C OR HIGHER |
|---|---|---|---|---|---|---|---|
| DRIVING PULSE | No.9 | No.8 | No.7 | No.6 | No.5 | No.4 | No.3 |

FIG. 11

| DEVIATION Vd_dev | Vd_dev < 0.955 | 0.955 ≤ Vd_dev < 0.965 | 0.965 ≤ Vd_dev < 0.975 | 0.975 ≤ Vd_dev < 0.985 | 0.985 ≤ Vd_dev < 0.995 | 0.995 ≤ Vd_dev < 1.005 | 1.005 ≤ Vd_dev < 1.015 | 1.015 ≤ Vd_dev < 1.025 | 1.025 ≤ Vd_dev < 1.035 | 1.035 ≤ Vd_dev < 1.045 | 1.045 ≤ Vd_dev |
|---|---|---|---|---|---|---|---|---|---|---|---|
| PULSE SHIFT NUMBER | +5 | +4 | +3 | +2 | +1 | 0 | -1 | -2 | -3 | -4 | -5 |

FIG. 13

| | | INK TEMPERATURE | | | | | | |
|---|---|---|---|---|---|---|---|---|
| | | LOWER THAN 20°C | 20°C TO LOWER THAN 30°C | 30°C TO LOWER THAN 40°C | 40°C TO LOWER THAN 50°C | 50°C TO LOWER THAN 60°C | 60°C TO LOWER THAN 70°C | 70°C OR HIGHER |
| DEVIATION Vd_dev | Vd_dev < 0.955 | No.12 | No.12 | No.12 | No.11 | No.10 | No.9 | No.8 |
| | 0.955 ≤ Vd_dev < 0.965 | No.12 | No.12 | No.11 | No.10 | No.9 | No.8 | No.7 |
| | 0.965 ≤ Vd_dev < 0.975 | No.12 | No.11 | No.10 | No.9 | No.8 | No.7 | No.6 |
| | 0.975 ≤ Vd_dev < 0.985 | No.11 | No.10 | No.9 | No.8 | No.7 | No.6 | No.5 |
| | 0.985 ≤ Vd_dev < 0.995 | No.10 | No.9 | No.8 | No.7 | No.6 | No.5 | No.4 |
| | 0.995 ≤ Vd_dev < 1.005 | No.9 | No.8 | No.7 | No.6 | No.5 | No.4 | No.3 |
| | 1.005 ≤ Vd_dev < 1.015 | No.8 | No.7 | No.6 | No.5 | No.4 | No.3 | No.2 |
| | 1.015 ≤ Vd_dev < 1.025 | No.7 | No.6 | No.5 | No.4 | No.3 | No.2 | No.1 |
| | 1.025 ≤ Vd_dev < 1.035 | No.6 | No.5 | No.4 | No.3 | No.2 | No.1 | No.0 |
| | 1.035 ≤ Vd_dev < 1.045 | No.5 | No.4 | No.3 | No.2 | No.1 | No.0 | No.0 |
| | 1.045 ≤ Vd_dev | No.4 | No.3 | No.2 | No.1 | No.0 | No.0 | No.0 |

FIG. 20

| | 15 | ACTUAL DISCHARGE AMOUNT | DISCHARGE AMOUNT DEVIATION (FIRST RATIO) Vd_dev |
|---|---|---|---|
| 210 | Seg.1 ⋮ Seg.160 | 4.8 ng | 1.067 |
| 209 | Seg.161 ⋮ Seg.320 | 4.7 ng | 1.044 |
| 208 | Seg.321 ⋮ Seg.480 | 4.6 ng | 1.022 |
| 207 | Seg.481 ⋮ Seg.640 | 4.5 ng | 1.000 |
| 206 | Seg.641 ⋮ Seg.800 | 4.5 ng | 1.000 |
| 205 | Seg.801 ⋮ Seg.960 | 4.5 ng | 1.000 |
| 204 | Seg.961 ⋮ Seg.1120 | 4.5 ng | 1.000 |
| 203 | Seg.1121 ⋮ Seg.1280 | 4.6 ng | 1.022 |
| 202 | Seg.1281 ⋮ Seg.1440 | 4.7 ng | 1.044 |
| 201 | Seg.1441 ⋮ Seg.1600 | 4.8 ng | 1.067 |

FIG. 22

| | 15 | ACTUAL DISCHARGE AMOUNT | DISCHARGE AMOUNT DEVIATION (SECOND RATIO) Vd_dev |
|---|---|---|---|
| 210 | Seg.1 ⋮ Seg.160 | 4.8 ng | 1.039 |
| 209 | Seg.161 ⋮ Seg.320 | 4.7 ng | 1.017 |
| 208 | Seg.321 ⋮ Seg.480 | 4.6 ng | 0.996 |
| 207 | Seg.481 ⋮ Seg.640 | 4.5 ng | 0.974 |
| 206 | Seg.641 ⋮ Seg.800 | 4.5 ng | 0.974 |
| 205 | Seg.801 ⋮ Seg.960 | 4.5 ng | 0.974 |
| 204 | Seg.961 ⋮ Seg.1120 | 4.5 ng | 0.974 |
| 203 | Seg.1121 ⋮ Seg.1280 | 4.6 ng | 0.996 |
| 202 | Seg.1281 ⋮ Seg.1440 | 4.7 ng | 1.017 |
| 201 | Seg.1441 ⋮ Seg.1600 | 4.8 ng | 1.039 |

INKJET PRINTING APPARATUS AND INKJET PRINTING METHOD

BACKGROUND OF THE INVENTION

Field of the Invention

The present invention relates to an inkjet printing apparatus and an inkjet printing method.

Description of the Related Art

There is conventionally known an inkjet printing apparatus that uses a print head having print element arrays in which a plurality of print elements generating energy for discharging inks is arranged to apply a driving pulse to the print elements and drive the print elements so that the inks are discharged onto a printing medium to print an image. In such an inkjet printing apparatus, it is known that the driving pulse is formed from a pre-pulse for raising the temperature of the inks so as not to discharge the inks and a main pulse for discharging the inks.

It is known that, as the temperature of the inks near the print elements at the time of discharging the inks becomes higher, the viscosity and surface tension of the inks near the print elements may vary to increase the discharge amount of the inks. This may lead to deterioration in the quality of images to be printed according to the temperature of the inks at the time of discharging. To handle this problem, Japanese Patent Application Laid-Open No. H5-31905 discloses a technique by which a driving pulse table defined by a plurality of driving pulses different in the pulse width of the pre-pulse is used such that the driving pulse with a smaller pulse width of the pre-pulse is selected from the driving pulse table when the temperature of the inks is higher and the selected driving pulse is applied to the print elements. According to the description in the literature, even when the temperature of the inks varies, the discharge amount of the inks can be controlled to be almost constant, thereby suppressing deterioration in image quality.

In the manufacturing process of the print head, a manufacturing error of the discharge ports may occur to cause the deviation of the discharge amount of the inks from the print elements from a desired amount. This may cause the deterioration of quality of images to be printed.

For example, if a manufacturing error occurs so that the discharge amounts from all the print elements in the print element arrays are larger than the desired amount, when the driving pulse is applied to the print elements according to the technique described in Japanese Patent Application Laid-Open No. H5-31905, the images printed in all printing areas on the printing medium have higher densities than a desired one.

In addition, the likelihood of occurrence of manufacturing error of the discharge ports described above varies depending on the position in the print element arrays. For example, it is known that, in the manufacturing process of the print head, a manufacturing error may occur frequently in particular such that the discharge amounts from the print elements at the end portions of the print element arrays become larger than the desired one. In this case, the images with higher densities than the desired one are printed in the area on the printing medium printed by the print elements at the end portions of the print element arrays, which results in deterioration of image quality.

SUMMARY OF THE INVENTION

The present invention is devised in view of the foregoing. Embodiments of the present invention allow image printing with image quality deterioration to be suppressed even when there is a difference in the discharge amount resulting from a manufacturing error of the discharge ports.

One example of the present invention includes: a print head that has a print element array in which a plurality of print elements is arranged in a predetermined direction to generate energy for discharging inks with application of a driving pulse; a first acquisition means that acquires information about the deviation of the discharge amount from the plurality of print elements in the print element array; a second acquisition means that acquires information about the temperature of the print head during print operation; a decision means that decides a first driving pulse based on the information about the deviation of the discharge amount acquired by the first acquisition means and the information about the temperature acquired by the second acquisition means; and a control means that performs control such that the first driving pulse decided by the decision means is applied to the print elements to discharge the inks onto a printing medium and print an image.

Further features of the present invention will become apparent from the following description of exemplary embodiments (with reference to the attached drawings).

BRIEF DESCRIPTION OF THE DRAWINGS

FIGS. 7A and 7B are diagrams for describing a general driving pulse control.

FIGS. 10A and 10B are diagrams for describing a driving pulse control in the embodiment.

FIG. 11 is a diagram showing a pulse shift table in the embodiment.

FIG. 13 is a diagram illustrating a driving pulse table in the embodiment.

FIG. 20 is a schematic view of an example of deviations in the discharge amount.

FIG. 22 is a schematic view of an example of deviations in the discharge amount.

DESCRIPTION OF THE EMBODIMENTS

A first embodiment of the present invention will be described below in detail with reference to the drawings.

(First Embodiment)

Figure 1:
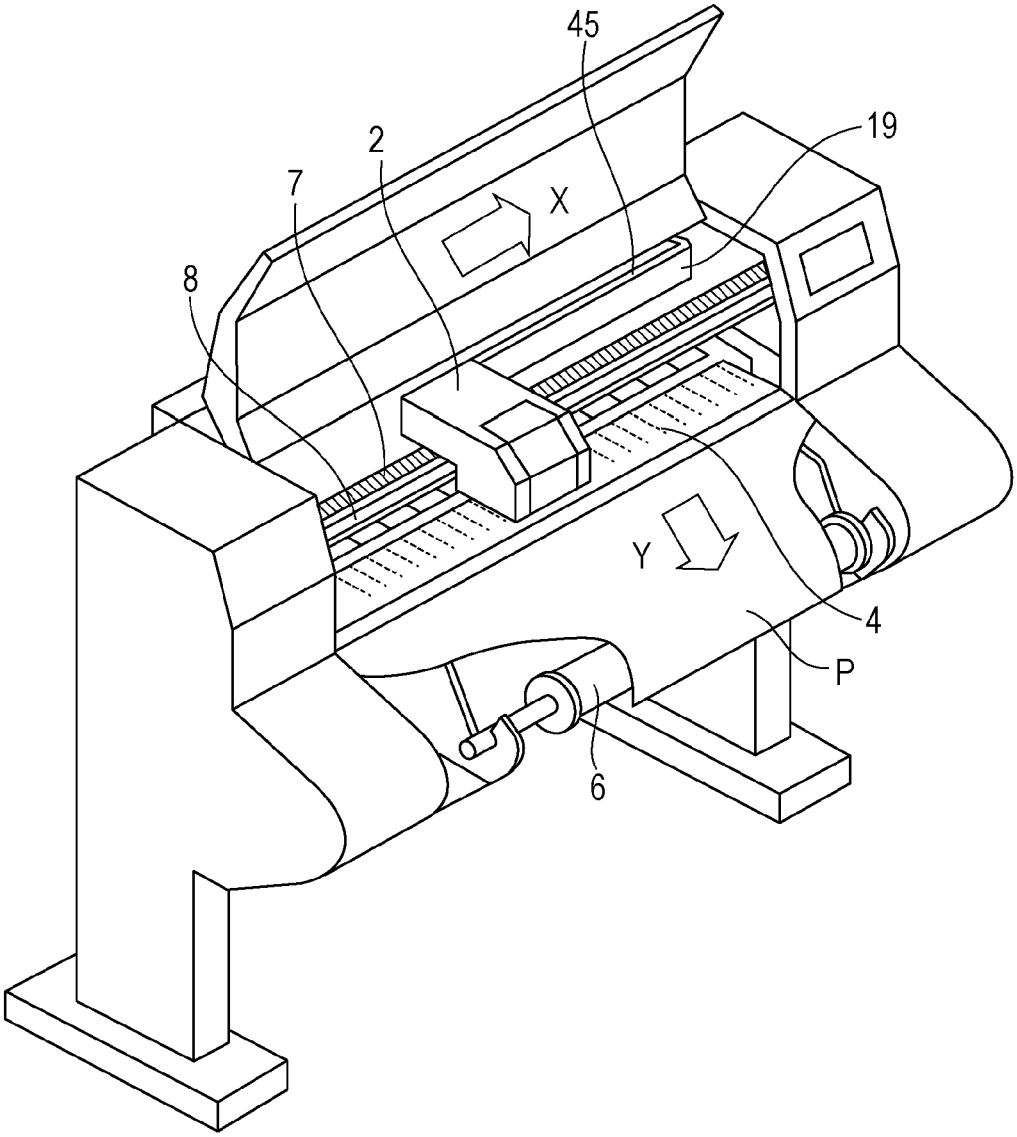
FIG. 1 is a perspective view of an inkjet printing apparatus according to an embodiment.

FIG. 1 illustrates the external appearance of an inkjet printing apparatus (hereinafter, also referred to as printer) according to the embodiment. This is a serial scanning-type printer that scans a print head in a cross direction (X direction) orthogonal to a direction of conveyance (Y direction) of a printing medium P to print an image on the printing medium P.

Referring to FIG. 1, the configuration of the inkjet printing apparatus and the overview of printing operation by the inkjet printing apparatus will be described. First, the printing medium P is conveyed in the Y direction from a spool 6 holding the printing medium P by a conveyance roller, not illustrated, driven via a gear by a conveyance motor. Meanwhile, a carriage unit 2 is scanned by a carriage motor not illustrated in a predetermined conveyance position along a guide shaft 8 extending in the X direction. In the course of the scanning, a print head (described later) attachable to the carriage unit 2 discharges inks from discharge ports at timing based on a position signal obtained by an encoder 7 to print a specific bandwidth corresponding to the range of arrangement of the discharge ports. In the embodiment, the scanning is performed at a scan rate of 40 inches per second and the ink discharging is performed with a resolution of 600 dpi (1/600 inch). After that, the printing medium P is conveyed for printing of the next bandwidth.

In such a printer, the image may be printed in a unit area on the printing medium at one scan (one-pass printing) or the image may be printed at a plurality of scans (multipass printing). In the case of one-pass printing, the printing medium may be conveyed by a bandwidth between individual scans. In the case of multipass printing, the printing medium may not be conveyed at each scan but may be conveyed by about one band to a unit area on the printing medium after a plurality of scans in the unit area. As another multipass printing method, data skipped by a predetermined mask pattern is printed at each scan, the paper is fed by about 1/n band, and then the scan is performed again such that the image is completed by performing scanning and conveyance a plurality of (n) times with the use of different nozzles related to the printing for the unit area on the printing medium.

A carriage belt can be used to transfer driving force from the carriage motor to the carriage unit 2. Alternatively, instead of the carriage belt, another driving system may be used such as one including a lead screw rotationally driven by the carriage motor and extending in the X direction and an engagement portion provided at the carriage unit 2 to engage with the groove in the lead screw, for example.

The fed printing medium P is sandwiched and conveyed between a feed roller and a pinch roller and guided to the printing position on a platen 4 (main scanning area of the print head). In the non-operating state, generally, the orifice face of the print head is capped and therefore the cap is removed to bring the print head or the carriage unit 2 to the scannable state before the printing. After that, when data for one scan is accumulated in a buffer, the carriage motor scans the carriage unit 2 to perform printing as described above.

A flexible wiring substrate 19 is attached to the print head to supply a driving pulse for discharge driving, a head temperature adjustment signal, and the like. The other side of the flexible wiring substrate is connected to a control unit (not illustrated) including a control circuit such as a CPU executing the control of the printer. A thermistor (not illustrated) as a temperature sensor is provided in the vicinity of the control unit to detect the atmosphere temperature in the inkjet printing apparatus.

Figure 2:
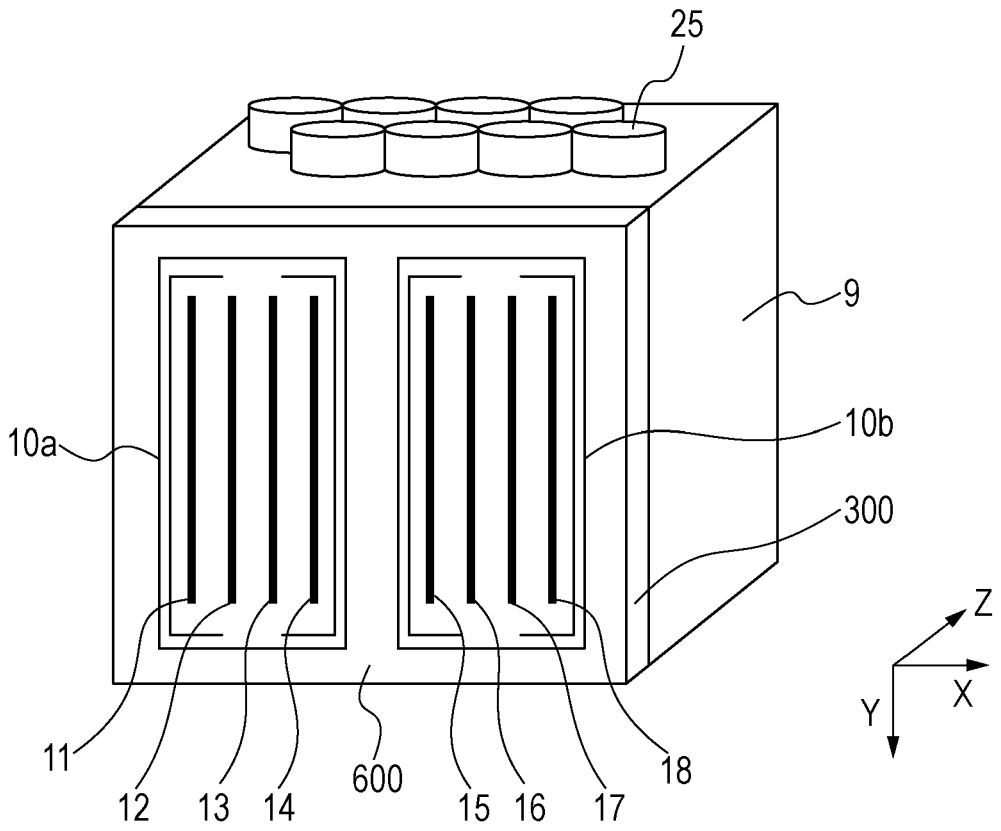
FIG. 2 is a schematic view of a print head according to the embodiment.

FIG. 2 is a perspective schematic view of a print head 9 according to the embodiment.

A joint portion 25 is formed on the print head 9. Ink supply tubes are connected to the joint portion 25.

Two print element substrates 10*a* and 10*b* formed of semiconductors or the like are attached to a discharge port formation surface of the print head 9 opposed to the printing medium P. The print element substrates 10*a* and 10*b* have discharge port arrays formed along the Y direction orthogonal to the X direction. More specifically, the print element substrate 10*a* has a discharge port array 11 for discharging a black (Bk) ink, a discharge port array 12 for discharging a gray (Gy) ink, a discharge port array 13 for discharging a light gray (Lgy) ink, and a discharge port array 14 for discharging a light cyan (Lc) ink arranged in the X direction. The print element substrate 10*b* has a discharge port array 15 for discharging a cyan (C) ink, a discharge port array 16 for discharging a light magenta (Lm) ink, a discharge port array 17 for discharging a magenta (M) ink, and a discharge port array 18 for discharging a yellow (Y) ink arranged in the X direction.

The printing substrates 10*a* and 10*b* have print element arrays in the positions opposed to the discharge port arrays 11 to 18 as described later. In the following description, for the sake of simplicity, the print element arrays opposed to the discharge port arrays 11 to 18 will be called print element arrays 11*x* to 18*x*.

The print element substrates 10*a* and 10*b* are fixed with an adhesive to a support member 300 formed from alumina, resin, or the like. The print element substrates 10*a* and 10*b* are electrically connected to an electric wiring member 600 provided with wires to perform signal communications with the print head 9 via the electric wiring member 600.

Figure 3A:
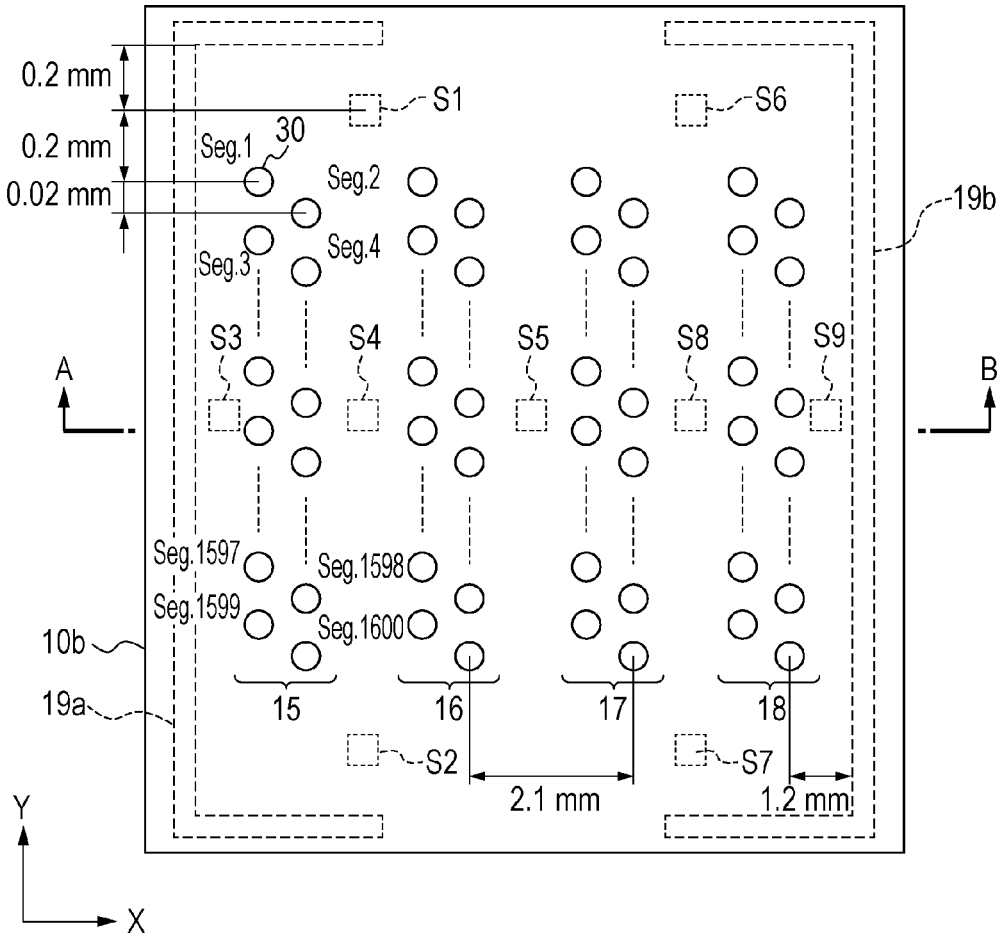
FIGS. 3A and 3B are a perspective view of the print head according to the embodiment.
Figure 3B:
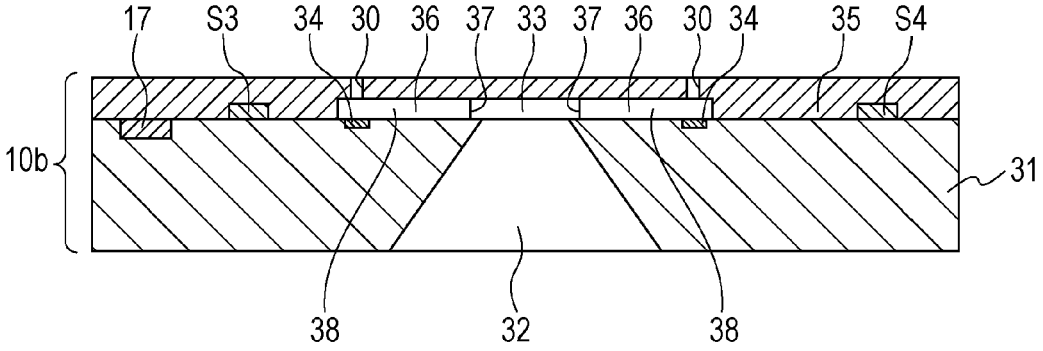

FIG. 3A is a perspective view of the print element substrate 10*b* as seen from the direction vertical to an XY plane. FIG. 3B is a cross-sectional view of the print element substrate 10*b* taken along a line AB illustrated in FIG. 3A vertically to the print element substrate 10*b*, showing the discharge port array 15 and its neighborhood seen from the downstream side in the Y direction. Although FIGS. 3A and 3B illustrate the components at dimensional ratios different from actual ones for the sake of simplicity, the print element substrate 10*b* is actually 9.55 mm in the X direction and 42.0 mm in the Y direction.

In the embodiment, each of the discharge port arrays 11 to 18 is composed of two lines. The two opposed lines are shifted from each other by one dot at 1200 dpi (dot/inch), and include 800 each discharge ports 30 and print elements as electro-thermal conversion elements (hereinafter, also referred to as main heaters) 34 opposed to the discharge ports 30, total 1600, arranged in the Y direction (predetermined arrangement direction). In the embodiment, 1200 dpi is equivalent to about 0.02 mm. By applying a pulse to the print elements, it is possible to produce thermal energy for discharging inks from the discharge ports. Although, in this example, the electro-thermal conversion elements are used as print elements, piezoelectric transducers or the like may be used instead.

In the following description, for the sake of simplicity, out of the 1600 discharge ports 30 and print elements 34, the discharge port 30 and the print element 34 positioned on the most downstream side in the Y direction will be also collectively called Seg. 1. The discharge port 30 and the print element 34 positioned on the upstream in the Y direction relative to Seg. 1 will be also called Seg. 2. Similarly, Seg. 3 to Seg. 1599 will be defined. The discharge port 30 and the print element 34 positioned on the most upstream side in the Y direction will be collectively called Seg. 1600.

The print element substrate 10*b* has total nine diode sensors S1 to S9 as temperature sensors for detecting the temperatures of the inks near the print elements.

Of these sensors, the two diode sensors S1 and S6 are arranged near first ends of the discharge port arrays 15 to 18 in the Y direction. More specifically, the diode sensors S1 and S6 are positioned at 0.2 mm away from the discharge ports of the first ends in the Y direction. The diode sensor S1 is interposed between the discharge port array 15 and the discharge port array 16 in the X direction, and the diode sensor S6 is interposed between the discharge port array 17 and the discharge port array 18 in the X direction.

The two diode sensors S2 and S7 are arranged near the second ends of the discharge port arrays 15 to 18 in the Y direction. The diode sensor S2 is interposed between the discharge port array 15 and the discharge port array 16 in the X direction. The diode sensor S7 is interposed between the discharge port array 17 and the discharge port array 18 in the X direction. More specifically, the diode sensors S2 and S7 are positioned at 0.2 mm away from the discharge ports of the second ends in the Y direction.

The five diode sensors S3, S4, S5, S8, and S9 are arranged in the middles of the discharge port arrays 15 to 18 in the Y direction. The diode sensor S4 is interposed between the discharge port array 15 and the discharge port array 16 in the X direction. The diode sensor S5 is interposed between the discharge port array 16 and the discharge port array 17 in the X direction. The diode sensor S8 is interposed between the discharge port array 17 and the discharge port array 18 in the X direction. The diode sensor S3 is arranged more outside than the discharge port array 15 in the X direction. The diode sensor S9 is arranged more outside than the discharge port array 18 in the X direction.

In the embodiment, the temperature of the inks in the discharge ports near the diode sensors is almost the same as the temperature of the print element substrate 10*b* in the positions where the diode sensors are provided, and therefore the temperature of the print element substrate 10*b* will be regarded as the temperature of the inks.

The print element substrate 10*b* also has heating elements (hereinafter, also called sub heaters) 19*a* and 19*b* to heat the inks in the discharge ports. The heating element 19*a* is formed as one member surrounding the side of the discharge port array 15 on which the diode sensor S3 is provided in the X direction. Similarly, the heating element 19*b* is formed as one member covering the side of the discharge port array 18 on which the diode sensor S9 is provided in the X direction. The heating elements 19*a* and 19*b* are positioned 1.2 mm outside from the discharge port array 13 in the X direction and 0.2 mm outside from the diode sensors S1, S2, S6, and S7 in the Y direction.

The print element substrate 10*b* is composed of a substrate 31 on which various circuits are formed and a discharge port member 35 formed of a resin as well as the diode sensors S1 to S9 and the sub heaters 19*a* and 19*b*. A common ink chamber 33 is formed between the substrate 31 and the discharge port member 35, and communicates with an ink supply opening 32. Ink flow paths 36 extend from the common ink chamber 33 and communicate with the discharge ports 30 formed in the discharge port member 35. Foaming chambers 38 are formed at the ends of the ink flow paths 36 on the discharge port 30 side. The print elements (main heaters) 34 are arranged in the foaming chambers 38 in the positions opposed to the discharge ports 30. Nozzle filters 37 are formed between the ink flow paths 36 and the common ink chamber.

The print element substrate 10*b* has been described in detail so far. However, the print element substrate 10*a* is configured in almost the same manner.

In the embodiment, for the print element arrays 15*x* to 18*x*, representative temperatures are calculated from temperatures detected from different combinations of the diode sensors S1 to S9, and a driving pulse control described later is executed based on the representative temperatures calculated for the respective print element arrays. More specifically, to execute the driving pulse control on the print element array 15*x*, the average value of temperatures detected from the four diode sensors S1 to S4 surrounding the print element array 15*x* is set as a representative temperature. To execute the driving pulse control on the print element array 16*x*, the average value of temperatures detected from the four diode sensors S1, S2, S4, and S5 surrounding the print element array 16*x* is set as a representative temperature. To execute the driving pulse control on the print element array 17*x*, the average value of temperatures detected from the four diode sensors S5 to S8 surrounding the print element array 17*x* is set as a representative temperature. To execute the driving pulse control on the print element array 18*x*, the average value of temperatures detected from the four diode sensors S6 to S9 surrounding the print element array 18*x* is set as a representative temperature.

However, the method for calculating the representative temperatures is not limited to the foregoing one. For example, the representative temperatures may be calculated with the use of the maximum values of temperatures detected from the four diode sensors surrounding the print element arrays 15*x* to 18*x*. Alternatively, for all the print element arrays 15*x* to 18*x*, the representative temperatures may be calculated with the use of the average value of temperatures detected from the nine diode sensors S1 to S9 provided on the print element substrate 10*b*. In the embodiment, a plurality of diode sensors may not be provided in the print head as illustrated in FIG. 3A but at least one diode sensor needs to be provided in the print head.

Figure 4:
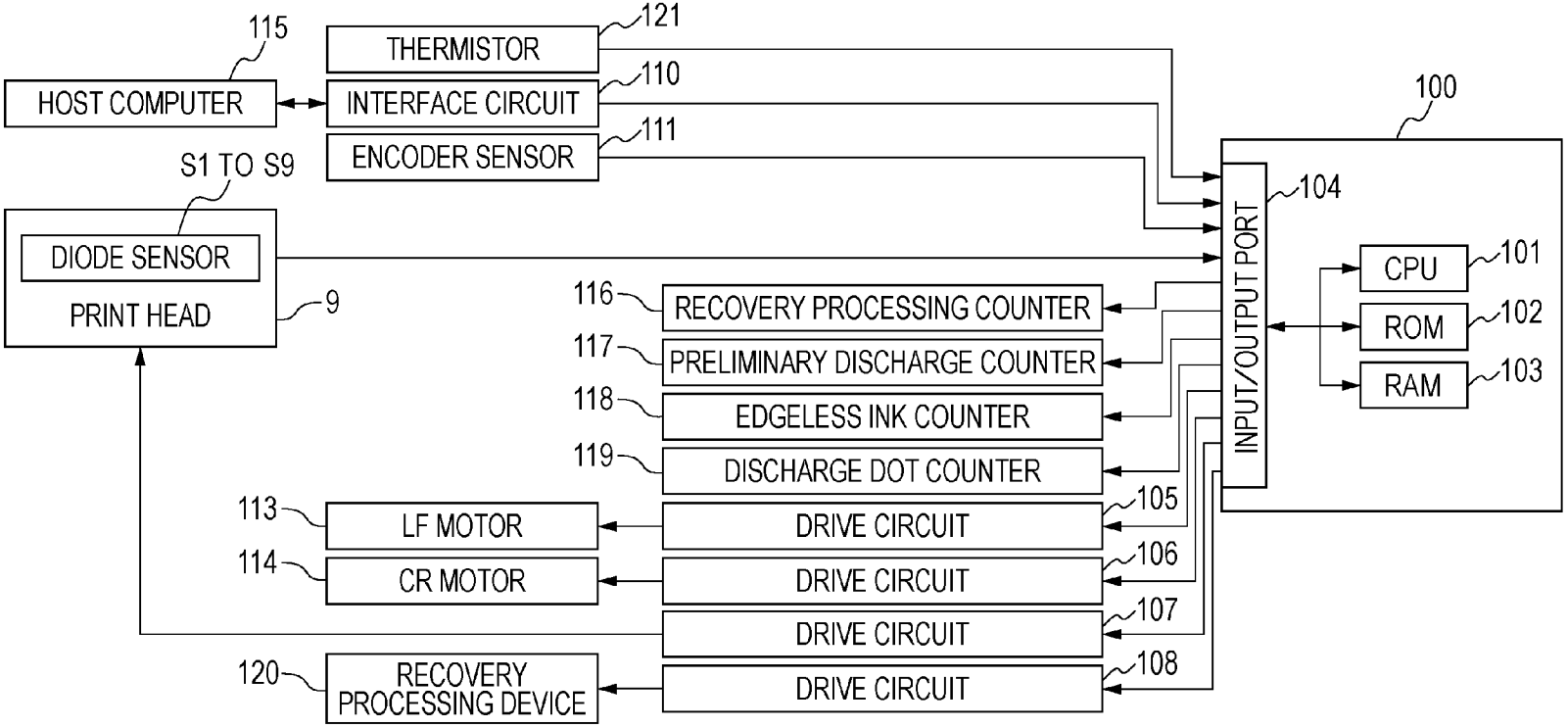
FIG. 4 is a diagram illustrating a print control system in the embodiment.

FIG. 4 is a block diagram illustrating a configuration of a control system mounted in the inkjet printing apparatus of the embodiment. A main control unit 100 includes a CPU 101 that executes operations such as computation, control, determination, and setting. The main control unit 100 also includes a ROM 102 that serves as a memory storing control programs and others to be executed by the CPU 101, a RAM 103 that is used as a buffer storing binary printing data indicative of discharge/non-discharge of inks, a work area for processing by the CPU 101, and the like, and an input/output port 104, and others. The RAM 103 can also be used as a storage means that stores the amount of an ink in the main tank, the amount of space in the sub tank, and others. The input/output port 104 connects to drive circuits 105 to 108 for a conveyance motor (LF motor) 113 driving the conveyance roller, a carriage motor (CR motor) 114, the print head 9, and a recovery processing device 120. These drive circuits 105 to 108 are controlled by the main control unit 100. The input/output port 104 also connects to various sensors such as the diode sensors S1 to S9 detecting the temperature of the print head 9, an encoder sensor 111 fixed to the carriage 2, and a thermistor 121 detecting the atmosphere temperature (environment temperature) in the printing apparatus. The main control unit 100 also connects to a host computer 115 via an interface circuit 110.

The drive circuit 107 serving as a signal transmitter to the print head transmits a driving pulse to be applied and print data to be printed. These are transferred via the flexible wiring substrate 190 described above.

Reference number 116 denotes a recovery processing counter that counts the amount of an ink forcibly ejected from the print head 9 by a recovery processing device 120. Reference number 117 denotes a preliminary discharge counter that counts the amount of preliminary discharge performed before the start of printing, at the end of printing, or during printing. Reference number 118 denotes an edgeless ink counter that counts the amount of an ink used for printing outside a printing medium area during edgeless printing. Reference number 119 denotes a discharge dot counter that counts the amount of an ink discharged during printing.

(General Driving Pulse Control)

Detailed description will be given as to a general example of a driving pulse control under which one of a plurality of driving pulses is selected according to the temperature of the inks and applied to the print elements 34 to generate heat in the print elements 34 and the inks are discharged by thermal energy resulting from the heat generation.

In the embodiment, a double pulse composed of a pre-pulse and a main pulse is used as a driving pulse to be applied.

Figure 6:
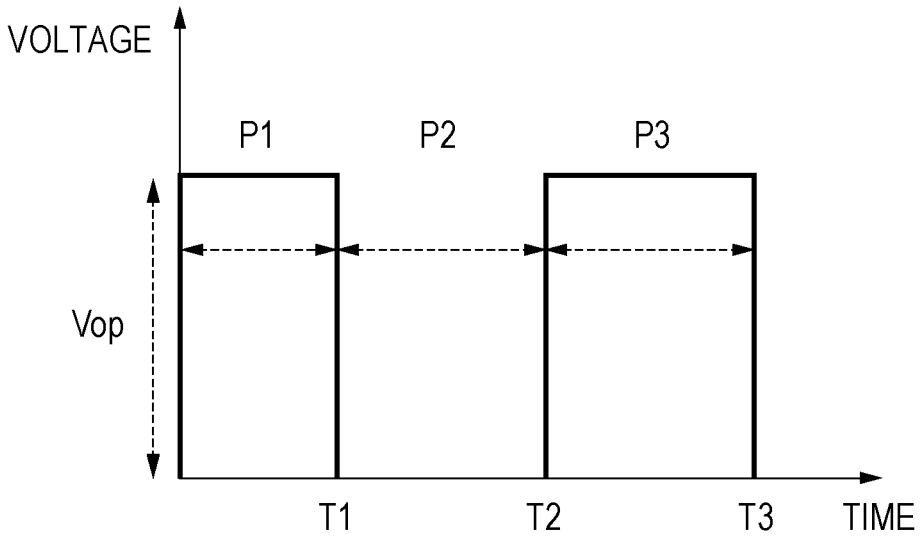
FIG. 6 is a diagram for describing the correlation among ink temperature, driving pulse, and ink discharge amount.

FIGS. 6A and 6B are diagrams for describing the double pulse. Reference sign Vop denotes a drive voltage, P1 the pulse width of the pre-pulse, P2 interval time, and P3 the pulse width of the main pulse. The ink discharge control is performed by controlling the pulse width of the pre-pulse and therefore the pre-pulse plays an important role.

The pre-pulse is applied mainly to heat the inks near the print elements to facilitate foaming. The pulse width of the pre-pulse is set to be equal to or less than the pulse width for generating energy smaller than the energy with which the inks become foamed.

The interval time refers to the duration of a certain time between the pre-pulse and the main pulse during which the heat generated by the application of the pre-pulse is sufficiently transferred to the inks near the print elements. The main pulse is used to cause foaming of the inks and discharge ink droplets.

Figure 5A:
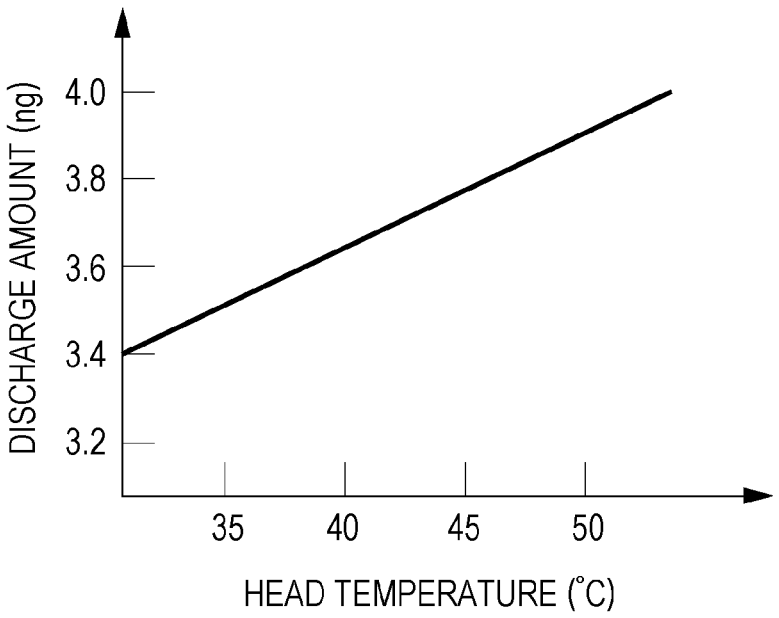
FIGS. 5A and 5B are diagrams for describing a driving pulse.

FIG. 5A is a diagram showing the relationship between the ink temperature and the ink discharge amount when the waveform of the driving pulse and the drive voltage Vop applied to the print elements 34 are fixed. It can be seen from the drawing that the ink discharge amount increases with rise in the temperature of the inks.

Figure 5B:
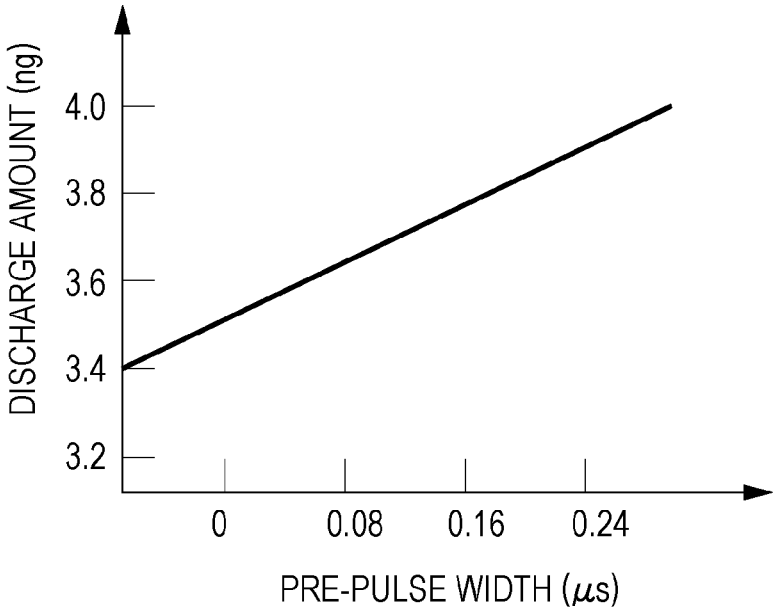

FIG. 5B is a diagram showing the relationship between the pulse width of the pre-pulse and the ink discharge amount when the interval time and the drive voltage Vop are fixed under the condition that the temperature of the inks is the same as that in the case of FIG. 6A. It can be seen from the drawing that ink discharge amount Vd increases in proportion to the increase in the pulse width P1 of the pre-pulse. The temperature of the ink rises as the pulse width P1 of the pre-pulse becomes larger and the amount of energy given by the pre-pulse increases, and the viscosity of the ink becomes lower accordingly. When the main pulse is applied with the lowered viscosity of the ink, the ink discharge amount increases. In contrast, when the main pulse is applied when the viscosity of the ink is not significantly lowered, the ink discharge amount decreases.

Accordingly, in the general drive pulse control, the pulse width of the pre-pulse is changed according to the temperature of the inks to suppress fluctuations in the ink discharge amount resulting from the change in the substrate temperature (ink temperature). Specifically, when the temperature of the inks is relatively low, the ink discharge amount may become lower, and therefore the pulse width P1 of the pre-pulse of the driving pulse to be applied to the print elements is set to be relatively large. This suppresses the reduction in the ink discharge amount. Similarly, when the temperature of the inks is relatively high, the pulse width P1 of the pre-pulse is set to be relatively small.

FIG. 7A is a diagram showing the waveforms of a plurality of driving pulses different in the pulse width P1 of the pre-pulse.

Seven driving pulses No. 0' to No. 6' are the same in drive voltage. The driving pulses No. 0' to No. 6' also have the same interval time P2 (P2=0.30 μs). Meanwhile, the driving pulses No. 0' to No. 6' are different in the pulse width P1 of the pre-pulse and the pulse width P3 of the main pulse.

Specifically, among the seven driving pulses, the driving pulse No. 0' has the smallest pulse width P1 of the pre-pulse (P1=0.12 μs) and has the largest pulse width P3 of the main pulse (P3=0.44 μs).

The driving pulse No. 1' has the pulse width P1 of the pre-pulse larger by 0.04 μs (P1=0.16 μs) than that of the driving pulse No. 0' and has the pulse width P3 of the main pulse smaller by 0.04 μs (P3=0.40 μs) than that of the driving pulse No. 0'.

The subsequent driving pulses with larger numbers have the pulse widths P1 of the pre-pulse increased by 0.04 μs each, and have the pulse widths P3 of the main pulse decreased by 0.04 μs each.

Among the seven driving pulses, the driving pulse No. 6' with the largest number has the largest pulse width P1 of the pre-pulse (P1=0.36 μs) and has the smallest pulse width P3 of the main pulse (P3=0.20 μs).

As illustrated in FIG. 7B, the ink discharge amount is larger with the larger pulse width P1 of the pre-pulse. Accordingly, when the driving pulses No. 0' to No. 6' illustrated in FIG. 7A are applied to the print element under the condition that the temperature of the ink is uniform, the ink discharge amount with the application of the driving pulse No. 0' is the minimum, and the ink discharge amount with the driving pulse No. 6' is the maximum. The driving pulses No. 0' to No. 6' have the larger pulse widths of the pre-pulse at regular intervals of 0.04 μs with the increase in number. Accordingly, the ink discharge amount increases by almost equal amount with the increase in driving pulse number.

FIG. 7B is a table diagram showing a relationship between the ink temperature and the driving pulse actually applied to the print element.

As described above, the ink discharge amount becomes larger at higher ink temperatures. To suppress fluctuations in the ink discharge amount resulting from the ink temperature, in the embodiment, the driving pulse with the smaller pulse width P1 of the pre-pulse is selected and applied at higher ink temperatures.

For example, as illustrated in FIG. 7B, when the ink temperature is as relatively low as lower than 20° C., the driving pulse No. 6' with the relatively large pulse width P1 of the pre-pulse as shown in FIG. 7A is selected. Meanwhile, when the ink temperature is as relatively high as 70° C. or more, the driving pulse No. 0' with the relatively small pulse width P1 of the pre-pulse as shown in FIG. 7A is selected.

Figure 8:
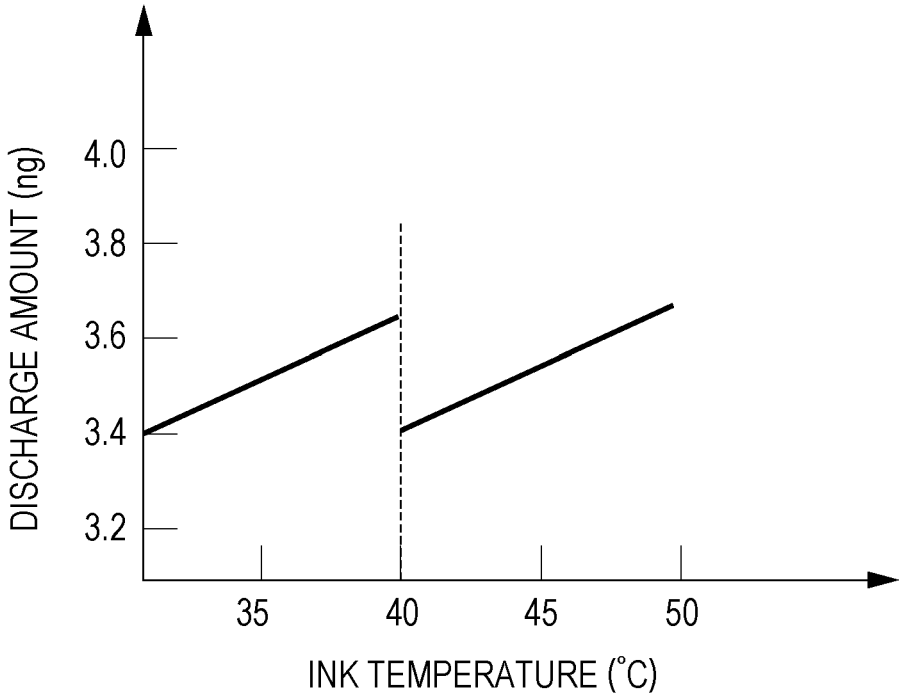
FIG. 8 is a diagram for describing the correlation between temperature and discharge amount under the driving pulse control.

FIG. 8 is a diagram showing the correlation between the ink temperature and the ink discharge amount when the driving pulse is selected and applied as shown in FIGS. 7A and 7B.

In the temperature range shown in FIG. 8, the driving pulse No. 4' is applied to the print elements at 30° C. to 40° C. as seen from FIG. 7B. In the meantime, the ink discharge amount increases with the rise in the ink temperature as in the case shown in FIG. 5A.

When the ink temperature exceeds 40° C., the driving pulse to be applied is changed to the driving pulse No. 3' smaller in the pulse width of the pre-pulse than the driving pulse No. 4'. Therefore, it is possible to suppress the increase in the ink discharge amount as shown in FIG. 8. By performing the driving pulse control in this manner, it is possible to perform printing while suppressing fluctuations in the ink discharge amount even with changes in the ink temperature.

(Correction of Deviation of the Discharge Amount Resulting from Manufacturing Error of the Discharge Ports)

As described above, manufacturing error of the discharge ports may occur during manufacture of the print element arrays to deviate the discharge amounts from the print elements from a desired one (reference value). In the event of the deviation, the quality of the resultant image becomes deteriorated.

For example, when the manufacturing error occurs such that the discharge amounts from all the print elements in the print element arrays become larger than the desired one, the execution of the general driving pulse control illustrated in FIGS. 7A and 7B would result in printing of the image with a density higher than a desired one in all the temperature areas. This is because the driving pulses No. 0' to No. 6' and the driving pulse table illustrated in FIGS. 7A and 7B are designed such that the discharge amounts from the print elements come close to the desired one without occurrence of manufacturing error in the respective temperature areas, and therefore the general driving pulse control cannot handle the deviation of the discharge amounts resulting from the manufacturing error of the discharge ports.

Accordingly, in the embodiment, the driving pulse is first tentatively decided according to the temperature, and then the tentative driving pulse is corrected based on the value of the deviation of the discharge amount resulting from the manufacturing error of the discharge ports (hereinafter, also referred to as discharge amount deviation Vd_dev), and the corrected driving pulse is decided as driving pulse to be actually applied to the print elements.

The driving pulse control of the embodiment will be described below in detail.

Figure 9:
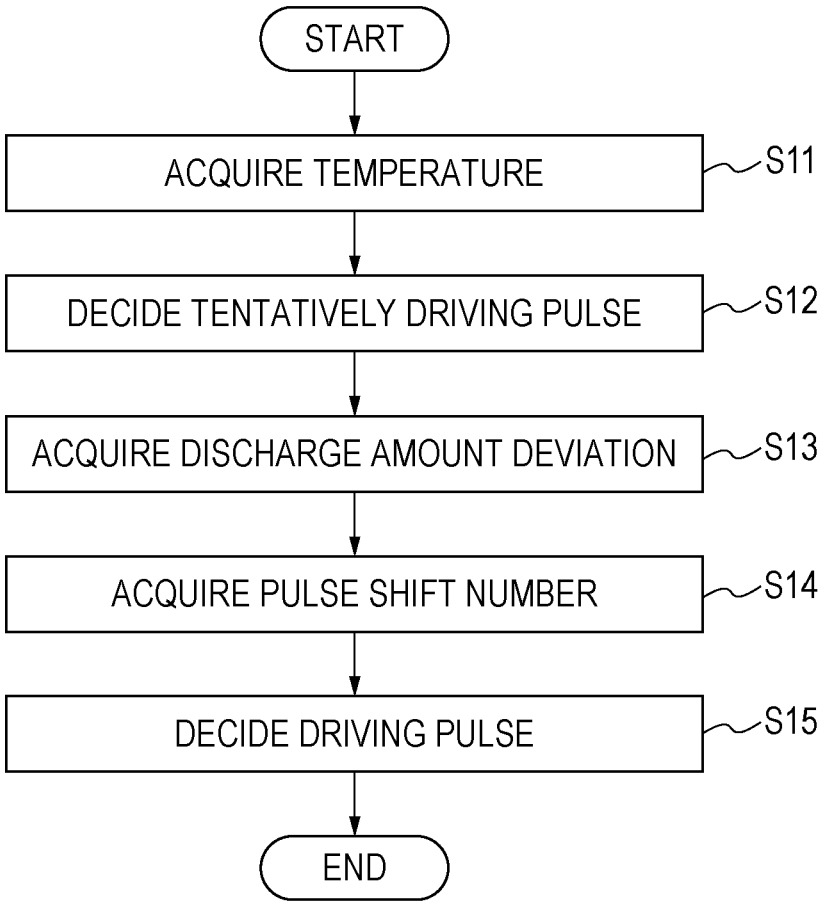
FIG. 9 is a flowchart of a driving pulse control method in the embodiment.

FIG. 9 is a flowchart of the driving pulse control executed by the CPU according to the control program of the embodiment.

In the embodiment, the driving pulse control is executed as illustrated in FIG. 9 at each 5 ms during the printing operation. The time interval of the driving pulse control is not limited to 5 ms but any other time interval can be set as appropriate.

When the driving pulse control is executed, first, the representative temperatures are acquired in the respective print element arrays at step S11.

Next, at step S12, the driving pulse table defining the correspondence between the driving pulses and the temperatures is used to decide tentatively one driving pulse based on the representative temperatures acquired at step S11.

FIG. 10A is a diagram showing the waveforms of the thirteen driving pulses different in the pulse width P1 of the pre-pulse for use in the embodiment. FIG. 10B is a diagram showing the driving pulse table defining the correspondence between the driving pulses and the temperatures for use in the tentative decision process (step S12) of the embodiment.

As seen from FIG. 10A, the thirteen driving pulses No. 0 to No. 12 are the same in drive voltage and interval time P2. The driving pulses No. 0 to No. 12 are defined such that, as the number for the driving pulse becomes larger, the pulse width P1 of the pre-pulse increases by 0.04 μm each and the pulse width P3 of the main pulse decreases by 0.04 μm each.

As seen from FIG. 10B, the driving pulse table in the embodiment is defined such that the driving pulse with the relatively large pulse width P1 of the pre-pulse is selected at a lower ink temperature as the driving pulse table illustrated in FIG. 7B is. For example, when the temperature is as relatively high as 70° C. or more, the driving pulse No. 3 with the relatively small pulse width P1 of the pre-pulse shown in FIG. 10A is selected. When the temperature is as relatively low as lower than 20° C., the driving pulse No. 9 with the relatively large pre-pulse width P1 shown in FIG. 10A is selected.

In this manner, at step S12 of the embodiment, one driving pulse is tentatively decided from among the driving pulses No. 0 to No. 12 using the driving pulse table as shown in FIGS. 10A and 10B.

Next, at step S13, the ratio of the actual discharge amount from the print elements to the desired discharge amount (hereinafter, also referred to as first ratio) is acquired as discharge amount deviation Vd_dev. For example, when the desired discharge amount is 4.5 ng and the actual discharge amount from the print elements is 4.6 ng, the first ratio as the discharge amount deviation Vd_dev is about 1.022 (=4.6 ng/4.5 ng).

When the deviations of the discharge amount occurs at varying degrees among the print elements due to manufacturing error of the discharge ports, the average value of the first ratios among the print elements is acquired as the discharge amount deviation Vd_dev. For example, when the desired discharge amount is 4.5 ng and the actual discharge amount from the print elements belonging to 800 Seg. 1 to Seg. 800 on the downstream side in the Y direction out of Seg. 1 to Seg. 1600 shown in FIGS. 3A and 3B is 4.2 ng, the first ratio of the print elements belonging to Seg. 1 to Seg. 800 is about 0.933 (=4.2 ng/4.5 ng). Meanwhile, when the actual discharge amount from the print elements belonging to 800 Seg. 801 to Seg. 1600 on the upstream side in the Y direction out of Seg. 1 to Seg. 1600 shown in FIGS. 3A and 3B is 4.7 ng, the first ratio of the print elements belonging to Seg. 801 to Seg. 1600 is about 1.044 (=4.7 ng/4.5 ng).

Therefore, the average value of the first ratios among the print elements as the discharge amount deviation Vd_dev is 0.989 (=(0.933+1.044)/2).

In the embodiment, the discharge amount deviation Vd_dev is determined by measuring the actual discharge amount after the manufacture of the print head and before the shipment of the print head. The determined discharge amount deviation Vd_dev is stored in advance in an EEPROM provided in the print head 9. Then, at step S13, the information stored in the EEPROM is read to acquire the discharge amount deviation Vd_dev.

When the same manufacturing error of the discharge port always occurs at the time of manufacture of the print heads, it is not necessarily required to store the discharge amount deviation Vd_dev for each of the print heads. For example, the discharge amount deviation Vd_dev determined in one print head may be stored in advance in the ROM 102 of the printing apparatus so that the information stored in the ROM 102 is read at step S13 to acquire the discharge amount deviation Vd_dev.

Next, at step S14, a pulse shift table defining the correspondence between the pulse shift numbers and the discharge amount deviations Vd_dev is used to acquire the pulse shift number by which a shift is to take place from the driving pulse tentatively decided at step S12.

FIG. 11 is a diagram showing the pulse shift table for use in the embodiment. As seen from FIG. 11, the pulse shift table in the embodiment defines eleven pulse shift numbers from "−5" to "+5" according to the discharge amount deviation Vd_dev.

The pulse shift number refers to a number by which to increase or decrease the number for the driving pulse tentatively decided at step S12.

For example, when the pulse shift number "+3" is acquired, the number for the tentatively decided driving pulse is increased by three. Therefore, when the pulse shift number "+3" is acquired when the driving pulse No. 4 is selected at step S12, the driving pulse No. 7 increased by three in number from the driving pulse No. 4 is acquired.

When the pulse shift number "−2" is acquired, the number for the tentatively decided driving pulse is decreased by two. Therefore, when the pulse shift number "−2" is acquired when the driving pulse No. 4 is selected at step S12, the driving pulse No. 2 decreased by two in number from the driving pulse No. 4 is acquired.

As seen from FIG. 11, the pulse shift table of the embodiment defines positive pulse shift numbers when the discharge amount deviation Vd_dev is smaller than 0.995. That is, when the actual discharge amount is smaller than the desired discharge amount due to the manufacturing error of the discharge ports, the driving pulse to be actually applied needs to change to the driving pulse with the larger pulse width P1 of the pre-pulse than that of the driving pulse tentatively decided at step S12. This reduces decrease in the discharge amount.

Meanwhile, the pulse shift table of the embodiment defines negative pulse shift numbers when the discharge amount deviation Vd_dev is larger than 1.005. That is, when the actual discharge amount is larger than the desired discharge amount due to the manufacturing error of the discharge ports, the driving pulse to be actually applied needs to change to the driving pulse with the smaller pulse width P1 of the pre-pulse than that of the driving pulse tentatively decided at step S12. This reduces increase in the discharge amount.

The pulse shift table of the embodiment further defines the pulse shift numbers with larger absolute values when the discharge amount deviation Vd_dev is more distant from 1. For example, when the discharge amount deviation Vd_dev is 1.005 or more and less than 1.015, the pulse shift number is "−1." Meanwhile, when the discharge amount deviation Vd_dev is 1.045 or more, the pulse shift number is "−5" that is larger in absolute value than "−1." This is because the increase/decrease in the actual discharge amount relative to the desired discharge amount due to the manufacturing error of the discharge ports becomes larger when the discharge amount deviation Vd_dev is more distant from 1, and therefore it is necessary to apply the driving pulse with the smaller/larger pulse width P1 of the pre-pulse to reduce the increase/decrease.

At step S15, the driving pulse to be applied to the print elements is decided based on the driving pulse tentatively decided at step S12 and the pulse shift number acquired at step S14. More specifically, as described above, the number for the driving pulse tentatively decided at step S12 is increased or decreased by the pulse shift number acquired at step S14 to decide the driving pulse to be applied to the print elements.

As described above, according to the embodiment, it is possible to discharge the inks with reduction in the deviation of the discharge amount even in the event of manufacturing error of the discharge ports.

(Second Embodiment)

In the first embodiment, the driving pulse to be applied to the print elements is decided by the use of the driving pulse table defining the correspondence between the temperatures and the driving pulses and the pulse shift table defining the correspondence between the discharge amount deviations Vd_dev and the pulse shift numbers.

In contrast to this, in the embodiment, the driving pulse to be applied to the print elements is decided by the use of a two-dimensional driving pulse table defining the correspondence between the temperatures, the discharge amount deviations Vd_dev, and the driving pulses.

The same contents as those of the first embodiment described above will not be explained.

Figure 12:
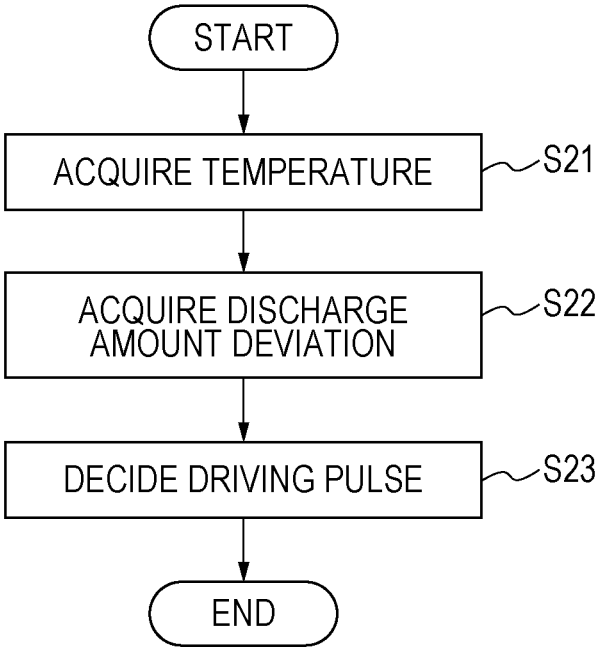
FIG. 12 is a flowchart of a driving pulse control method in the embodiment.

FIG. 12 is a flowchart of a driving pulse control executed by the CPU according to the control program in the embodiment. In the embodiment, as in the first embodiment, the driving pulse control as shown in FIG. 12 is executed at each 5 ms during the printing operation. The time interval can be set to be any different value as appropriate.

The temperature acquisition at step S21 and the acquisition of the discharge amount deviation Vd_dev at step S22 are the same as those at steps S11 and S13 shown in FIG. 9, and descriptions thereof will be omitted.

At step S23, with reference to the two-dimensional driving pulse table defining the correspondence between the temperatures, the discharge amount deviations Vd_dev, and the driving pulses, the driving pulse to be applied to the print elements is decided based on the temperature and the discharge amount deviation Vd_dev acquired at steps S21 and S22, respectively.

FIG. 13 is a diagram showing the driving pulse table for use in the embodiment.

As seen from FIGS. 13 and 10B, the driving pulses within a range of the discharge amount deviations Vd_dev of 0.995 to less than 1.005 in the driving pulse table shown in FIG. 13 for use in the embodiment and the driving pulses defined in the driving pulse table shown in FIG. 10B for use in the first embodiment are the same.

As seen from FIG. 13, the driving pulse table of the embodiment is configured such that, when the discharge amount deviation Vd_dev is constant, the driving pulse with the larger pulse width P1 of the pre-pulse is selected at a lower ink temperature. For example, when the discharge amount deviation Vd_dev is 0.995 or more and less than 1.005, the driving pulse No. 3 with the relatively small pulse width P1 of the pre-pulse shown in FIG. 10A is selected at a temperature of 70° C. or higher, and when the driving pulse No. 9 with the relatively large pulse width P1 of the pre-pulse shown in FIG. 10A is selected at a temperature lower than 20° C.

The driving pulse table of the embodiment is further configured such that, even when the temperature is constant, the driving pulse with the different pulse width P1 of the pre-pulse is selected depending on the discharge amount deviation Vd_dev. More specifically, when the discharge amount deviation Vd_dev is smaller than one, the driving pulse larger in pulse width P1 of the pre-pulse than the driving pulse to be selected when the discharge amount deviation Vd_dev is one (there is no fluctuation in the discharge amount due to the manufacturing error of the discharge ports) is selected. Therefore, when the actual discharge amount is smaller than the desired discharge amount due to the manufacturing error of the discharge ports, the driving pulse to be applied has the relatively large pulse width P1 of the pre-pulse, thereby reducing decrease in the discharge amount.

When the discharge amount deviation Vd_dev is larger than one, the driving pulse smaller in the pulse width P1 of the pre-pulse than the driving pulse to be selected when the discharge amount deviation Vd_dev is one (there is no fluctuation in the discharge amount due to the manufacturing error of the discharge ports) is selected. Therefore, when the actual discharge amount is larger than the desired discharge amount due to the manufacturing error of the discharge ports, the driving pulse to be applied has the relatively small pulse width P1 of the pre-pulse, thereby reducing increase in the discharge amount.

As the discharge amount deviation Vd_dev is more distant from one, the driving pulse with a larger difference in the pulse width P1 of the pre-pulse from the driving pulse to be selected when the discharge amount deviation Vd_dev is one (there is no fluctuation in the discharge amount due to the manufacturing error of the discharge ports) is selected. For example, when the temperature is 30° C. or more and lower than 40° C., the driving pulse No. 8 is selected with the discharge amount deviation Vd_dev of 0.985 or more and less than 0.995, and the driving pulse No. 12 is selected with the discharge amount deviation Vd_dev of less than 0.955. In this example, as seen from FIG. 10A, the difference in the pulse width P1 of the pre-pulse from the driving pulse No. 7 to be selected when the discharge amount deviation Vd_dev is one is 0.04 (=0.32−0.28) μm for the driving pulse No. 8 and is 0.20 (=0.48−0.28) μm for the driving pulse No. 12. This is because the increase/decrease in the actual discharge amount relative to the desired discharge amount due to the manufacturing error of the discharge ports becomes larger when the discharge amount deviation Vd_dev is more distant from 1, and therefore it is necessary to apply the driving pulse with the smaller/larger pulse width P1 of the pre-pulse to reduce the increase/decrease.

By applying the thus decided driving pulse to the print elements, it is possible to discharge the inks with the reduced deviation of the discharge amount even in the event of the manufacturing error of the discharge ports as in the first embodiment.

(Third Embodiment)

In the first and second embodiments, image printing is performed in a single print mode.

In contrast to this, in the embodiment, image printing is performed in a plurality of print modes with the use of different print elements.

The same contents as those of the first and second embodiments will not be described.

In the inkjet printing apparatus of the embodiment, there are two available print modes: "high-speed print mode" in which printing is performed with emphasis on printing speed; and "high-quality print mode" in which printing is performed with emphasis on image quality. In the high-speed print mode, while the print head scans once the unit area on the printing medium, all the print elements in the print element arrays discharge the inks to perform printing. In the high-quality print mode, the print head scans four times the unit area on the printing medium and some of the recording elements in the print element arrays discharge the inks at each of the four scans to perform printing.

The inkjet printing apparatus of the embodiment is set such that the user can select either the "high-quality print mode" or the "high-speed print mode" to perform printing under desired printing conditions.

In the inkjet printing apparatus of the embodiment, the print mode varies depending on the area to be printed on the one printing medium. More specifically, printing is performed with a switchover between "end area print mode" in which end areas of the printing medium in the Y direction (conveyance direction) are printed and "central area print mode" in which the central area other than the end areas is printed according to the area to be printed on the printing medium. In the embodiment, the number of the print elements in the print element arrays used in the "end area print mode" is smaller than the number of the print elements in the print element arrays used in the "central area print mode."

When the printing medium is roll paper, the central area on the printing medium refers to a central portion on the cut printing medium. The same thing applies to the end areas.

Figure 14A:
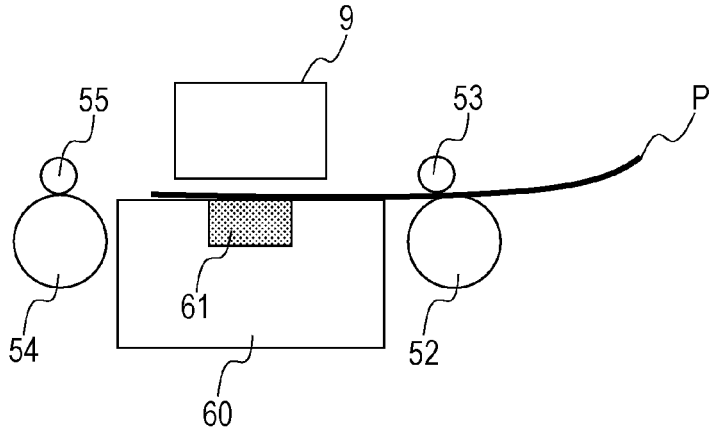
FIGS. 14A, 14B, and 14C are schematic views of an internal configuration of an image printing apparatus according to the embodiment.
Figure 14B:
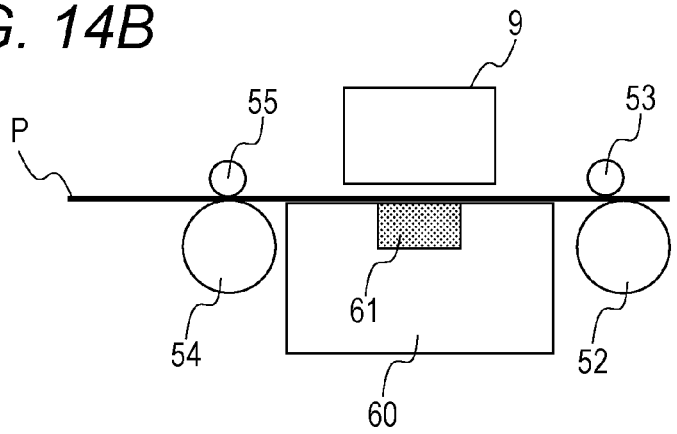
Figure 14C:
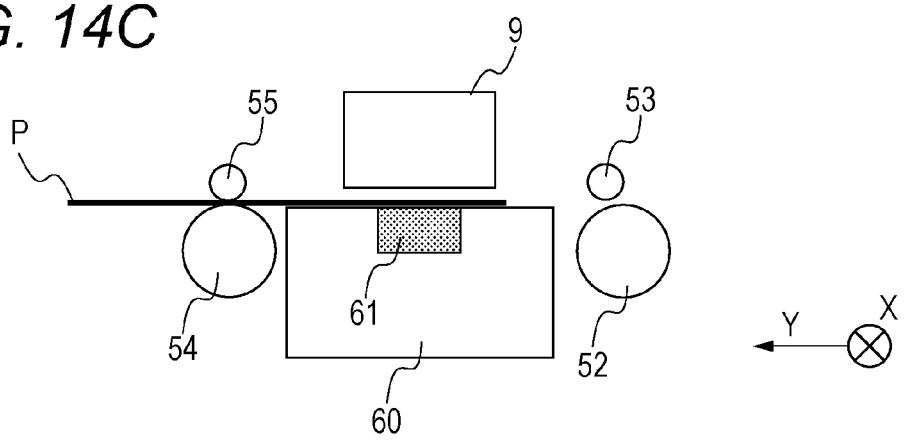

FIGS. 14A, 14B, and 14C are schematic diagrams of an internal configuration of the print head and its neighborhood in the inkjet printing apparatus of the embodiment. FIG. 14A is a schematic view showing the relative position of the printing medium P in the inkjet printing apparatus when the end portion of the printing medium P on the downstream side in the Y direction (hereinafter, referred to as front end area) is printed. FIG. 14B is a schematic view showing the relative position of the printing medium P in the inkjet printing apparatus when the area of the printing medium P other than the end area on the downstream side in the Y direction and the end area on the upstream side in the Y direction (hereinafter, also referred to as central area) is printed. FIG. 14C is a schematic view showing the relative position of the printing medium P in the inkjet printing apparatus when the end area of the printing medium P on the upstream side in the Y direction (hereinafter, referred to as rear end area) is printed.

The inkjet printing apparatus of the embodiment includes a pair of first conveyance rollers 52 and 53 and a pair of second conveyance rollers 54 and 55 that rotate with the printing medium P sandwiched therebetween to covey the printing medium P. The pair of first conveyance rollers 52 and 53 is intended to feed the printing medium P to the printing area and is provided on the upstream side of the print head 9 in the Y direction. The pair of second conveyance rollers 54 and 55 is intended to exit the printing medium P from the printing area and is provided on the downstream side of the print head 9 in the Y direction.

The inkjet printing apparatus of the embodiment further includes a platen 60 that supports the printing medium. The platen 60 has a groove in which an ink absorbing member 61 is placed to receive the inks discharged to outside the front and back edges and side edges of the printing medium during execution of margin-less printing.

As illustrated in FIG. 14B, to print the central area in the printing medium P, the printing medium P is sandwiched and conveyed between both the pair of first conveyance rollers 52 and 53 and the pair of second conveyance rollers 54 and 55.

However, to print the front end area of the printing medium P as illustrated in FIG. 14A, for example, the printing medium P is not sandwiched between the pair of second conveyance rollers 54 and 55 but is sandwiched and conveyed only between the pair of first conveyance rollers 52 and 53. In contrast, to print the rear end area of the printing medium P as illustrated in FIG. 14C, the printing medium P is not sandwiched between the pair of first conveyance rollers 52 and 53 but is sandwiched and conveyed only between the pair of second conveyance rollers 54 and 55.

Figure 18A:
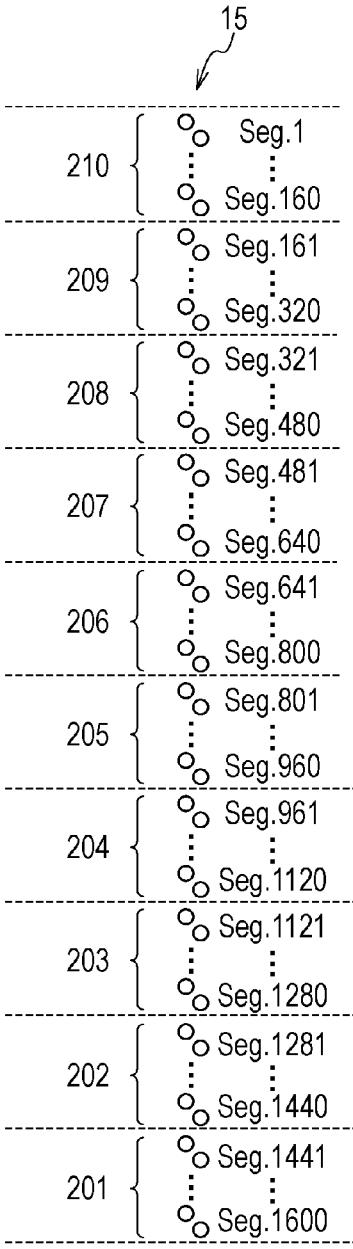
FIGS. 18A and 18B are schematic views for describing a print mode in the embodiment.
Figure 18B:
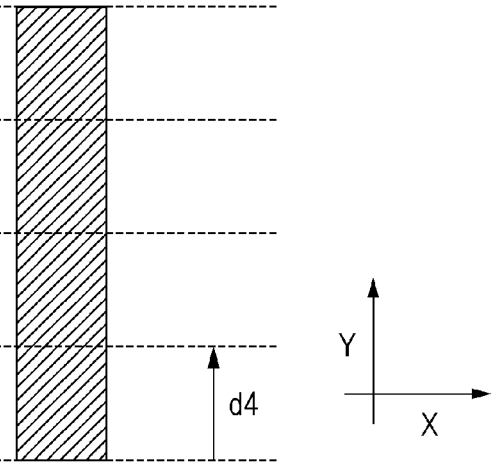

When the printing medium P is sandwiched only between the one pair of conveyance rollers as illustrated in FIGS. 14A and 14C, the conveyance of the printing medium P is more likely to be skewed as compared to the case where the printing medium P is sandwiched between the two pairs of conveyance rollers as illustrated in FIG. 18B. In the event of the skew of the printing medium P during conveyance, the inks may not be applied to the desired positions to cause deterioration in image quality.

In the embodiment, to print the front end area and the rear end area, that is, end areas of the printing medium P, the amount of conveyance of the printing medium P between printing scans in the multipass printing is decreased as compared to the case of printing the central area of the printing medium P. By decreasing the amount of conveyance each time, even when the skewing of the printing medium P occurs during conveyance, its influence can be reduced.

In accordance with the decrease in the amount of conveyance, the number of the used print elements is limited to print the end areas such that a smaller number of print elements than that for printing the central area is used to discharge the inks.

In summary, the inkjet printing apparatus of the embodiment can operate in the four print modes "high-speed central area print mode," "high-quality central area print mode," "high-speed end area print mode," and "high-quality end area print mode." The inkjet printing apparatus of the embodiment performs printing with print elements different in position and number among the respective four print modes.

In the following description, for the sake of simplicity, the "high-speed central area print mode" will be also called first print mode, the "high-quality central area print mode" second print mode, the "high-speed end area print mode" third print mode, and the "high-quality end area print mode" fourth print mode.

The "high-speed central area print mode," "high-quality central area print mode," "high-speed end area print mode," and "high-quality end area print mode" of the embodiment will be described below in detail.

FIGS. 15 to 18 describe the first to fourth print modes, respectively. For the sake of simplicity, out of the print element arrays 11 to 18, the print element array 15 that discharges cyan ink is taken as an example. The same control is also performed on the other print element arrays.

In addition, for the sake of simplicity, Seg. 1 to Seg. 1600 composed of the 1600 discharge ports 30 and the 1600 print elements 34 will be divided into ten groups 201 to 210. The group 201 includes Seg. 1441 to Seg. 1600 containing a print element group of 160 print elements 34. The group 202 includes Seg. 1281 to Seg. 1440 containing a print element group of 160 print elements 34. The other groups 203 to 210 have the same structure.

(High-Speed Central Area Print Mode)

Figure 15A:
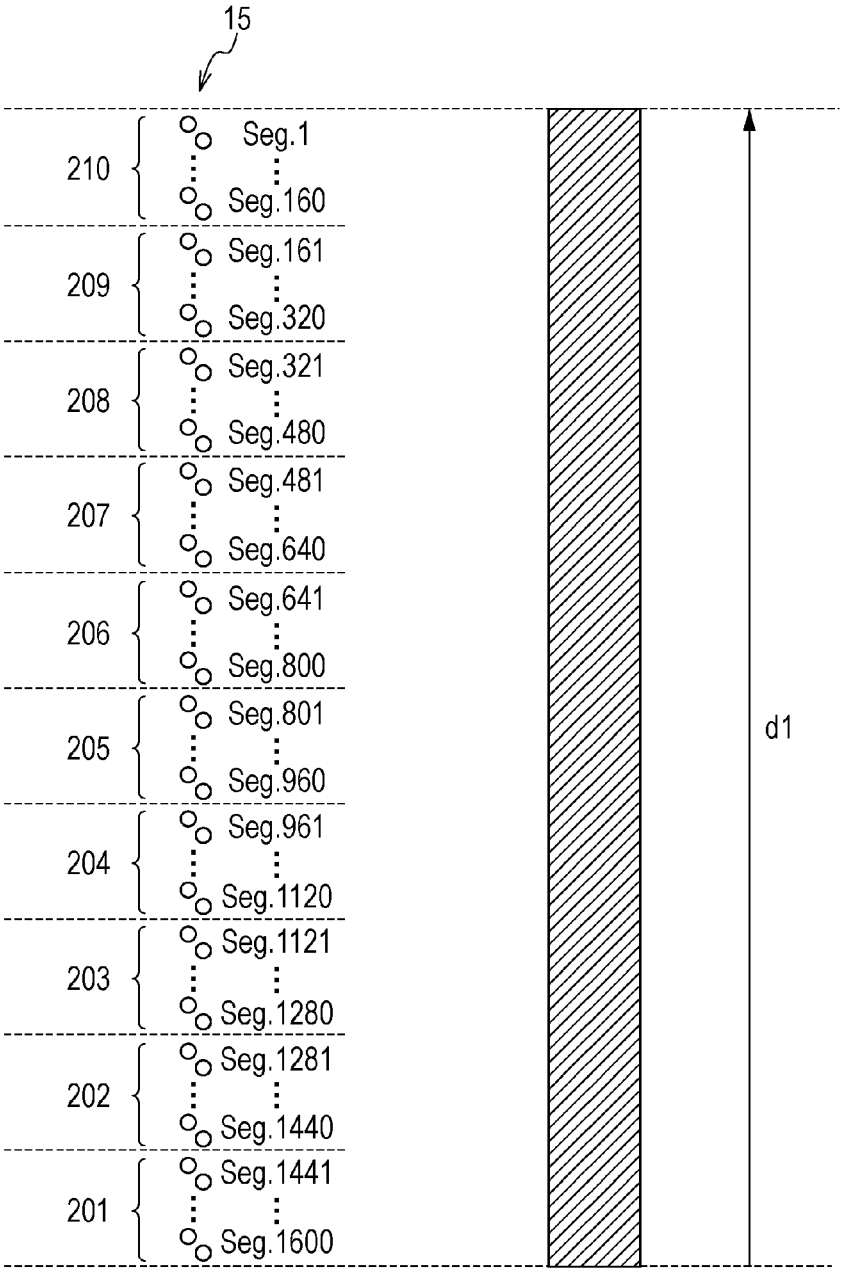
FIGS. 15A and 15B are schematic views for describing a print mode in the embodiment.
Figure 15B:
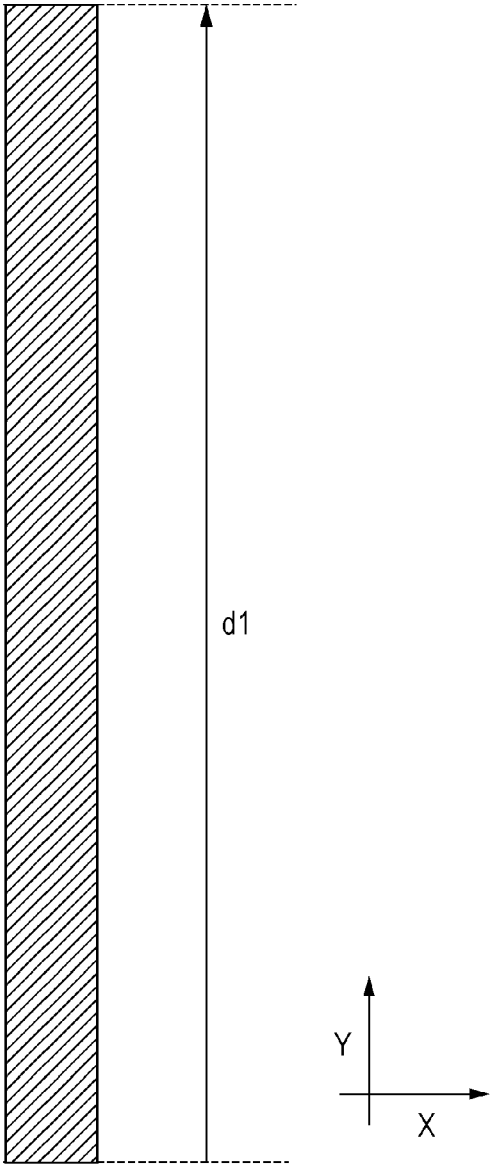

FIGS. 15A and 15B are diagrams for describing the first print mode of the embodiment. FIG. 15A shows the print element array 15 and FIG. 15B shows schematically the blackened range of the used print elements in the print element array 15 in the first print mode.

In the first print mode, the print elements of all the groups 201 to 210 in the print element array 15 discharge the inks at one scan to perform printing in one unit area (first unit area).

After that, the printing medium is conveyed by distance d1. In this example, the distance d1 is equivalent to the length of the ten groups 201 to 210 in the Y direction. Accordingly, the unit area to be printed next (adjacent to the first unit area on the upstream side in the Y direction) becomes opposed to the print element array 15.

In this state, the print elements of all the groups 201 to 210 in the print element array 15 discharge the inks at one scan to perform printing in the unit area to be printed next. In the subsequent process, similarly, while the printing medium is conveyed by the distance d1, the respective unit areas are scanned one time each with the discharge of the inks from the print elements of the ten groups 201 to 210 to print an image.

In this manner, in the first print mode of the embodiment, the print elements included in Seg. 1 to Seg. 1600 of the ten groups 201 to 210 are used to perform printing.

(High-Quality Central Area Print Mode)

Figure 16A:
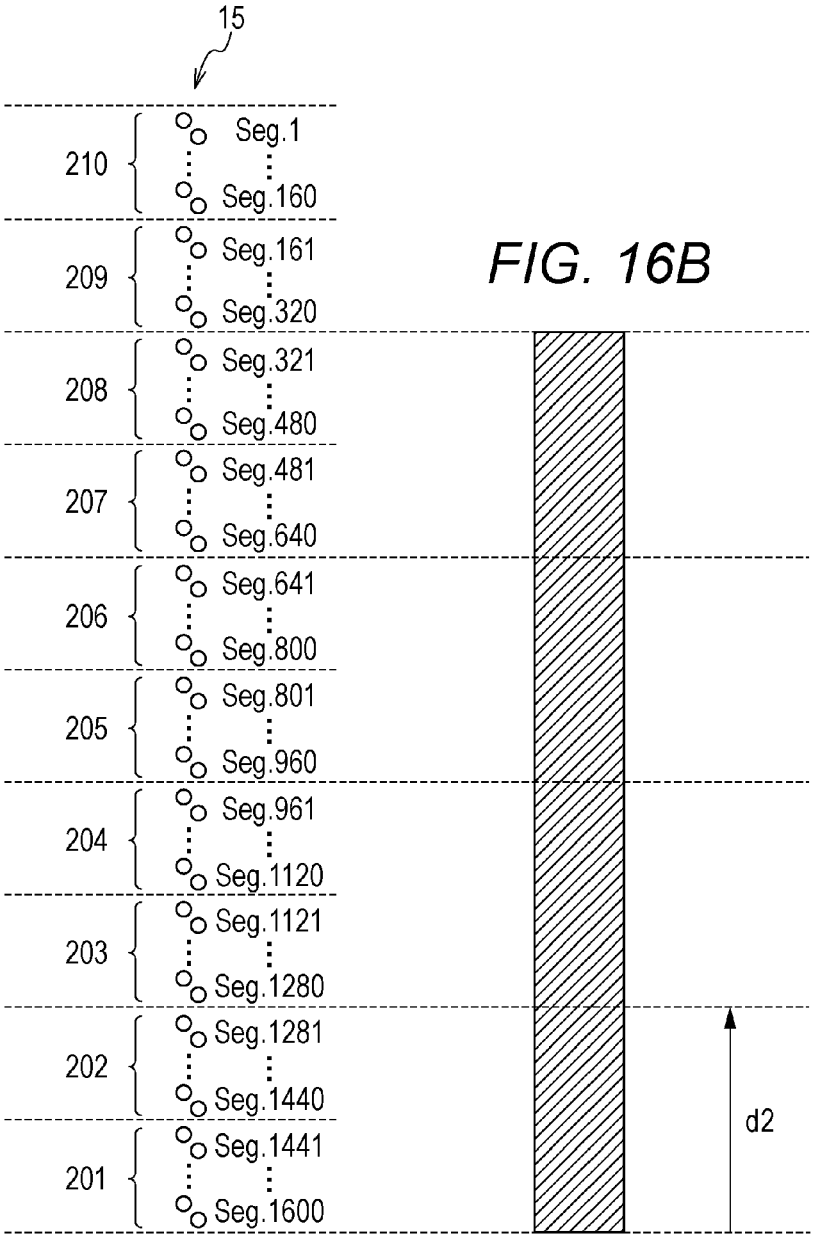
FIGS. 16A and 16B are schematic views for describing a print mode in the embodiment.
Figure 16B:
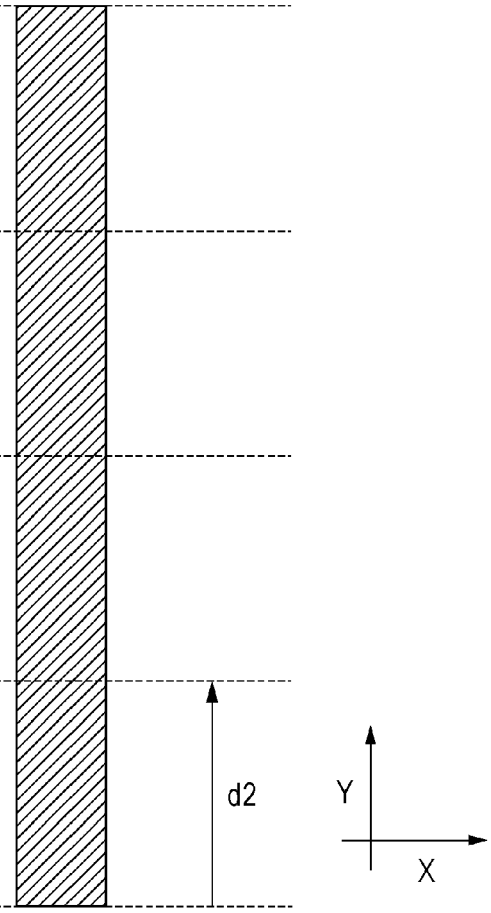

FIG. 16 is a diagram for describing the second print mode of the embodiment. FIG. 16A shows the print element array 15 and FIG. 16B shows schematically the blackened range of the used print elements in the print element array 15 in the second print mode.

In the second print mode, out of the ten groups 201 to 210, the eight groups 201 to 208 are used to perform printing. The two groups perform printing in a unit area at each scan, and the print head scans total four times to complete the printing in the unit area.

More specifically, the print elements of the two groups 201 and 202 first discharge the inks to a unit area (second unit area) at the first scan.

Then, the printing medium is conveyed by a distance d2. In this example, the distance d2 is equivalent to the length of the two groups out of the ten groups 201 to 210 in the Y direction. Accordingly, the second unit area printed by the groups 201 and 202 at the previous scan becomes opposed to the groups 203 and 204, and the unit area adjacent to the second unit area on the upstream side in the Y direction becomes opposed to the groups 201 and 202.

In this state, the second scan is performed in the second unit area, and the print elements of the two groups 203 and 204 discharge the inks to the second unit area. During this scan, the two groups 201 and 202 discharge the inks to the unit area adjacent to the second unit area on the upstream side in the Y direction.

In the subsequent process, similarly, while the printing medium is conveyed by the distance d2, the respective unit areas are scanned four times each with the discharge of the inks from the print elements of the two groups to print an image. The print elements of the groups 201 and 202 discharge the inks to the respective unit areas at the first scan, the print elements of the groups 203 and 204 discharge the inks to the respective unit areas at the second scan, the print elements of the groups 205 and 206 discharge the inks to respective unit areas at the third scan, and the print elements of the groups 207 and 208 discharge the inks to respective unit areas at the fourth scan.

In this manner, in the second print mode of the embodiment, the print elements of Seg. 321 to Seg. 1600 belonging to the eight groups 201 to 208 are used to perform printing.

(High-Speed End Area Print Mode)

Figure 17A:
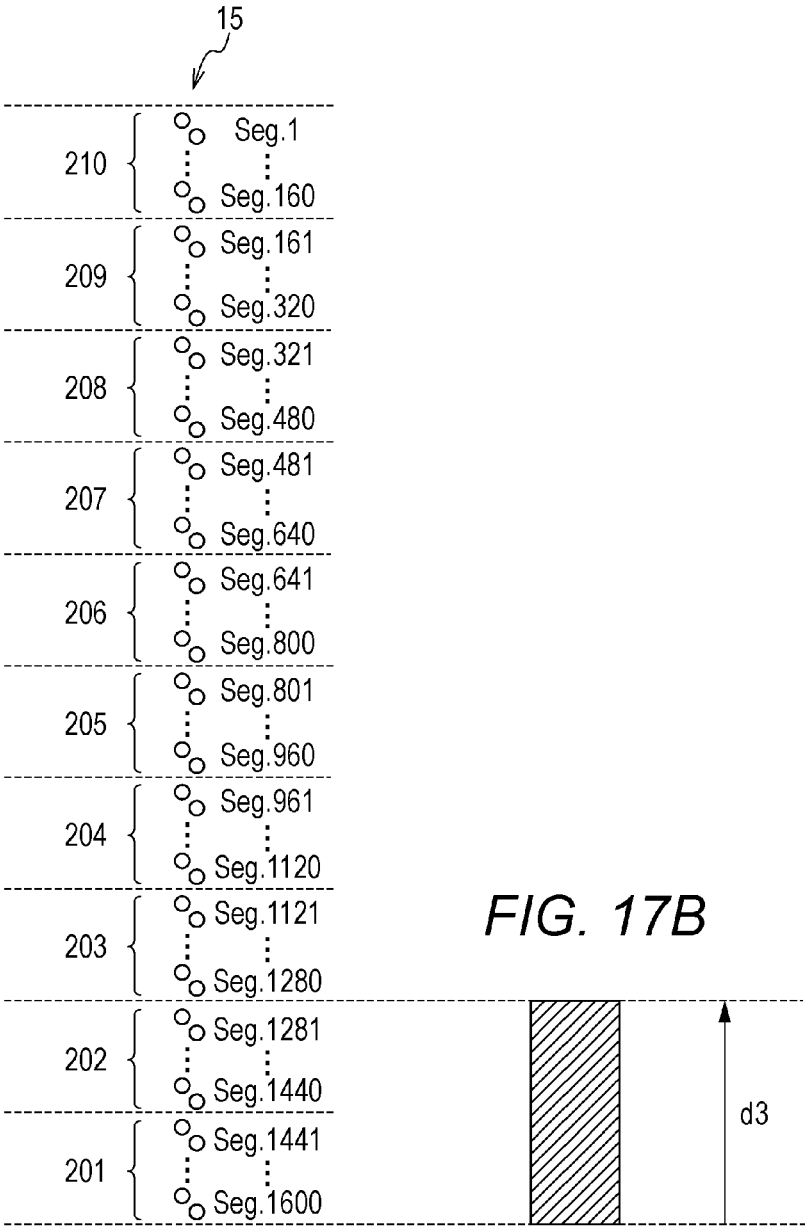
FIGS. 17A and 17B are schematic views for describing a print mode in the embodiment.
Figure 17B:
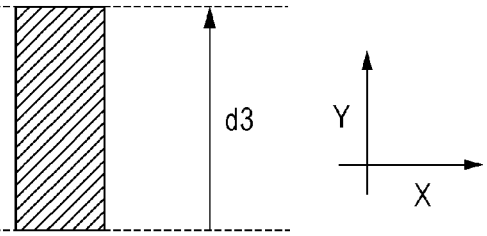

FIG. 17 is a diagram for describing the third print mode in the embodiment. FIG. 17A shows the print element array 15 and FIG. 17B shows schematically the blackened range of the used print elements in the print element array 15 in the third print mode.

In the third print mode, the two groups 201 and 202 out of the ten groups discharge the inks to perform printing in a unit area (third unit area).

Then, the printing medium is conveyed by a distance d3 (<d1). In this example, the distance d3 is equivalent to the length of the two groups out of the ten groups 201 to 210 in the Y direction. Accordingly, the unit area to be printed next (adjacent to the third unit area on the upstream side in the Y direction) becomes opposed to the print element array 15.

In this state, the print elements of the two groups 201 and 202 discharge the inks at one scan to perform printing in the unit area to be printed next. In the subsequent process, similarly, while the printing medium is conveyed by the distance d3, the respective unit areas are scanned one time each with the discharge of the inks from the print elements of the two groups 201 and 202 to print an image.

In this manner, in the third print mode of the embodiment, the print elements of Seg. 1281 to Seg. 1600 belonging to the two groups 201 and 202 are used to perform printing.

(High-Quality End Area Print Mode)

FIG. 18 is a diagram for describing the fourth print mode in the embodiment. FIG. 18A shows the print element array 15 and FIG. 18B shows schematically the blackened range of the used print elements in the print element array 15 in the fourth print mode.

In the fourth print mode, out of the ten groups 201 to 210, the four groups 201 to 204 are used to perform printing. One of the groups performs printing in a unit area at each scan, and the print head scans total four times to complete the printing in the unit area.

More specifically, the print elements of the one group 201 first discharge the inks to a unit area (fourth unit area) at the first scan.

Then, the printing medium is conveyed by a distance d4 (<d2). In this example, the distance d4 is equivalent to the length of the one group out of the ten groups 201 to 210 in the Y direction. Accordingly, the fourth unit area printed by the group 201 at the previous scan becomes opposed to the group 202, and the unit area adjacent to the fourth unit area on the upstream side in the Y direction becomes opposed to the group 201.

In this state, the second scan is performed in the fourth unit area, and the print elements of the one group 202 discharge the inks to the fourth unit area. During this scan, the one group 201 discharges the inks to the unit area adjacent to the fourth unit area on the upstream side in the Y direction.

In the subsequent process, similarly, while the printing medium is conveyed by the distance d4, the respective unit areas are scanned four times each with the discharge of the inks from the print elements of the one group to print an image. The print elements of the group 201 discharge the inks to the respective unit areas at the first scan, the print elements of the group 202 discharge the inks to the respective unit areas at the second scan, the print elements of the group 203 discharge the inks to respective unit areas at the third scan, and the print elements of the group 204 discharge the inks to respective unit areas at the fourth scan.

In this manner, in the fourth print mode of the embodiment, the print elements of Seg. 961 to Seg. 1600 belonging to the four groups 201 to 204 are used to perform printing.

As described above, in the embodiment, the first to fourth print modes different in the position and number of the used print elements (the range of the used print elements in the print element array) are available.

(Correction of Deviation of the Discharge Amount Due to Manufacturing Error of the Discharge Ports)

It is known that the manufacturing error of the discharge ports occurs in varying degrees depending on the position in the discharge port array. In particular, the manufacturing error is likely to occur with increase in the discharge amount from the discharge ports at the ends of the discharge port array. Accordingly, the deviation of the discharge amount may occur in varying degrees depending on the position in the discharge port array.

There are various possible causes for this. One of the major causes is estimated to reside in the molding process of the resin discharge port member 35. The discharge port member 35 is molded by putting the resin from the central portion of the discharge port array in the Y direction. When the end portions of the discharge port member 35 in the Y direction are depressed in the height direction, the depression possibly contributes to the increased discharge amounts from the end portions.

When the deviation of the discharge amount resulting from the manufacturing error of the discharge ports occurs in varying degrees depending on the position in the discharge port array, the quality of the printed image becomes deteriorated in varying degrees depending on the positions and number of the print elements used in printing.

For example, when manufacturing error occurs with increase in the discharge amount from some of the discharge ports in the discharge port array and manufacturing error occurs with decrease in the discharge amount at others of the discharge ports, the image printed with only some of the discharge ports has a density higher than the desired one. Meanwhile, the image printed with only the other discharge ports has a density lower than the desired one.

Therefore, when a plurality of print modes different in the position and number of the used print elements as in the embodiment, it is necessary to perform a driving pulse control taking into account the positions and the numbers of the print elements used in the respective print modes.

Figure 19:
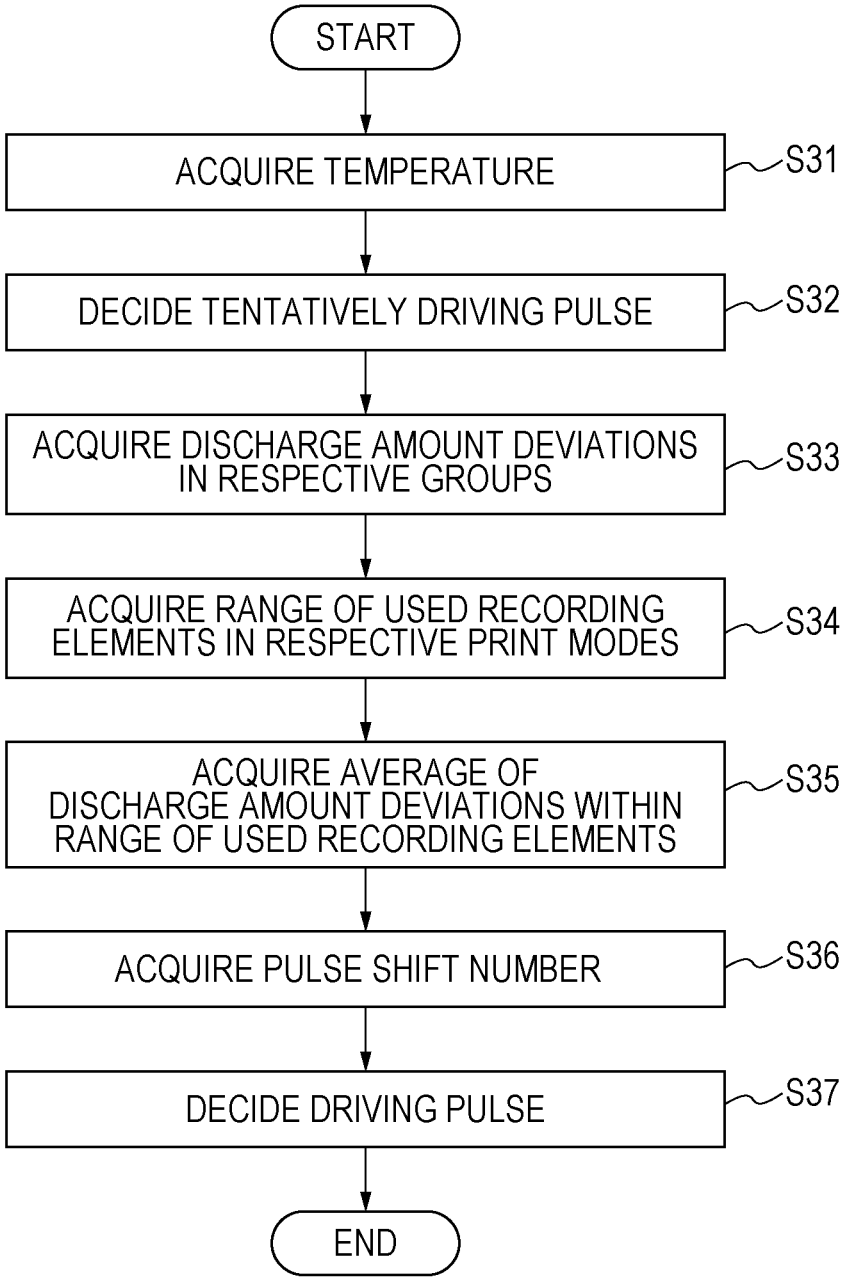
FIG. 19 is a flowchart of a driving pulse control method in the embodiment.

FIG. 19 is a flowchart of a driving pulse control executed by the CPU according to the control program in the embodiment.

The temperature acquisition at step S31 and the tentative decision of the driving pulse at step S32 are the same as those at steps S11 and S12 shown in FIG. 9, and therefore the descriptions thereof will be omitted.

Next, at step S33, the ratios (first ratios) of the actual discharge amounts from the print elements to the desired discharge amount in the respective groups 201 to 210 are acquired as the discharge amount deviations Vd_dev in the respective groups 201 to 210. For example, when the desired discharge amount is 4.5 ng and the actual discharge amount from the print elements of the group 201 is 4.6 ng, the first ratio as the discharge amount deviation Vd_dev in the group 201 is about 1.022 (=4.6 ng/4.5 ng).

When the deviation of the discharge amount due to the manufacturing error of the discharge ports occurs in varying degrees among the print elements of one group, the average of the first ratios among the print elements of the group is acquired as the discharge amount deviation Vd_dev. For example, when the desired discharge amount is 4.5 ng and the actual discharge amount from the print elements belonging to Seg. 1 to Seg. 80 of the group 210 shown in FIGS. 15, 16, 17, and 18 is 4.2 ng, the first ratio in the print elements belonging to Seg. 1 to Seg. 80 is about 0.933 (=4.2 ng/4.5 ng). Meanwhile, when the actual discharge amount from the print elements belonging to Seg. 81 to Seg. 160 of the group 210 is 4.7 ng, the first ratio in the print elements belonging to Seg. 81 to Seg. 160 is about 1.044 (=4.7 ng/4.5 ng). Therefore, the average value of the first ratios among the print elements as the discharge amount deviation Vd_dev of the group 210 is 0.989 (=(0.933+1.044)/2).

In the embodiment, the discharge amount deviations Vd_dev in the groups 201 to 210 are determined by measuring the actual discharge amounts after the manufacture of the print head and before the shipment of the print head. The determined discharge amount deviations Vd_dev in the respective groups are stored in advance in the EEPROM provided in the print head 9. Then, the information stored in the EEPROM is read at step S13 to acquire the discharge amount deviations Vd_dev in the respective groups.

When the same manufacturing error of the discharge port always occurs at the time of manufacture of the print heads, it is not necessarily required to store the discharge amount deviation Vd_dev for each of the print heads. For example, the discharge amount deviations Vd_dev in the respective groups determined in one print head may be stored in advance in the ROM 102 of the printing apparatus so that the information stored in the ROM 102 is read at step S33 to acquire the discharge amount deviations Vd_dev in the respective groups.

FIG. 20 is a diagram schematically showing the discharge amount deviations Vd_dev in the groups 201 to 210 acquired at step S33 when the manufacturing error occurs with increase in the discharge amounts from the end portions of the discharge port array, as an example of manufacturing error of the discharge ports.

As seen from FIG. 20, in this example, no manufacturing error of the discharge ports occurs in the groups 204 to 207 in the middle of the discharge port array, and the actual discharge amount is 4.5 ng that is equal to the desired discharge amount. Therefore, the discharge amount deviation Vd_dev in the groups 204 to 207 is 1.000 (=4.5 ng/4.5 ng).

Meanwhile, the actual discharge amounts from the groups positioned nearer the end portions are larger than the desired discharge amount. The actual discharge amount is 4.6 ng in the groups 203 and 208, 4.7 ng in the groups 202 and 209, and 4.8 ng in the groups 201 and 210. Therefore, the discharge amount deviation Vd_dev is 1.022 (=4.6 ng/4.5 ng) in the groups 203 and 208, 1.044 (=4.7 ng/4.5 ng) in the groups 202 and 209, and 1.067 (=4.8 ng/4.5 ng) in the groups 201 and 210.

Next, at step S34, the information about the range of the print elements used in the current print mode is acquired. In this example, the information for specifying the groups used in the respective print modes is acquired as the range of the print elements. For example, when printing is performed in the first print mode as shown in FIG. 15, the information for specifying the ten groups 201 to 210 is acquired. When printing is performed in the second print mode as shown in FIG. 16, the information for specifying the eight groups 201 to 208 is acquired.

Next, at step S35, out of the discharge amount deviations Vd_dev in the respective groups acquired at step S33, the average value of the discharge amount deviations Vd_dev in the groups falling within the range of the print elements used in the current print mode acquired at step S34 is calculated, and the value of the average is acquired as discharge amount deviation average Vd_ave. For example, when printing is performed in the first print mode shown in FIG. 15, the sum of the discharge amount deviations Vd_dev in the ten groups 201 to 210 is calculated and the sum is divided by 10 to determine the discharge amount deviation average Vd_ave. When printing is performed in the second print mode, the sum of the discharge amount deviations Vd_dev in the eight groups 201 to 208 is calculated and the sum is divided by 8 to determine the discharge amount deviation average Vd_ave.

Figure 21:
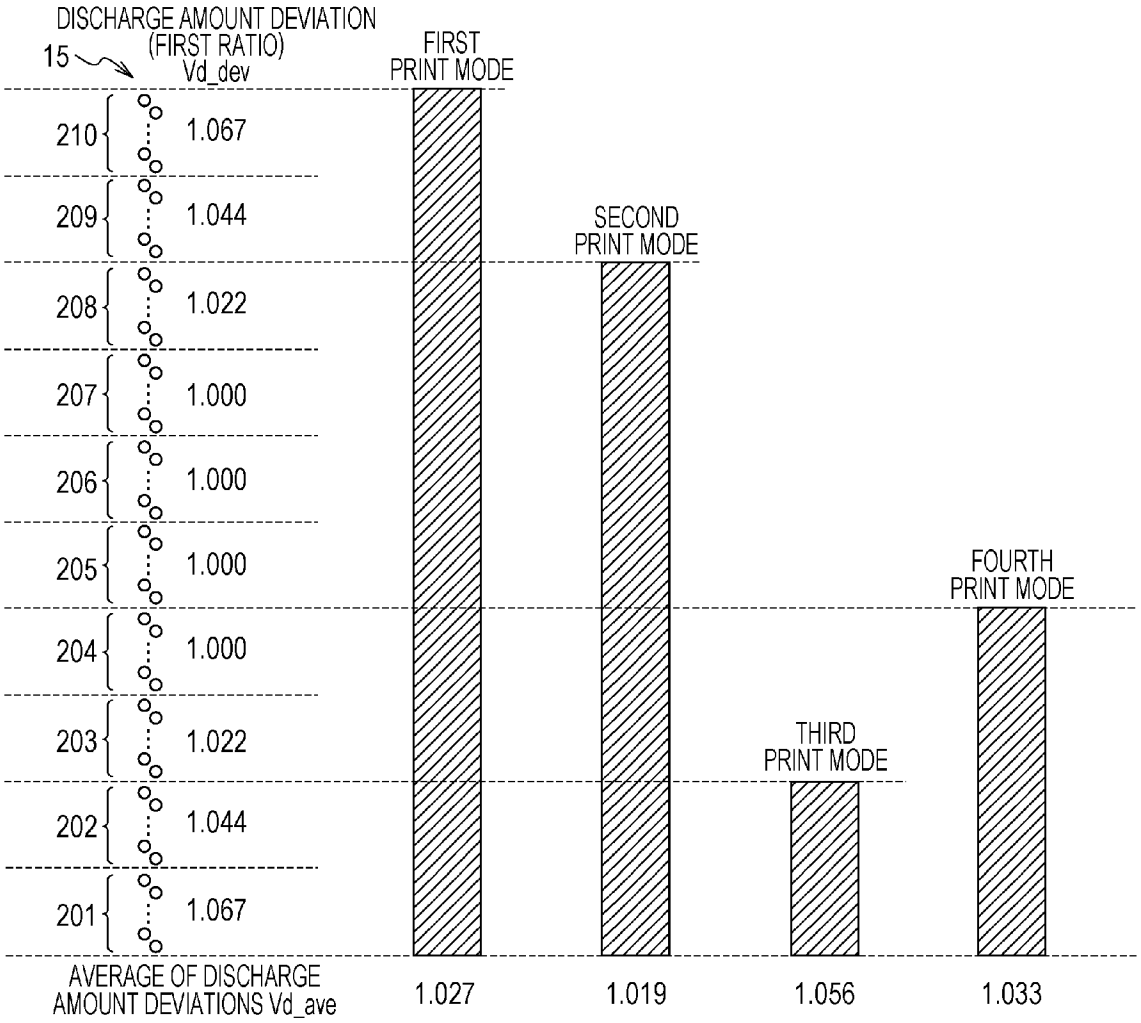
FIG. 21 is a schematic view for describing a method for calculating the average of deviations in the discharge amount.

FIG. 21 is a diagram for describing schematically the discharge amount deviation averages Vd_ave in the first to fourth print modes acquired at step S35 when the manufacturing error of the discharge ports occurs as shown in FIG. 20.

In the first print mode, the print elements of the ten groups 201 to 210 discharge the inks. Therefore, the discharge port deviation average Vd_ave in the first print mode is calculated to be 1.027 (=(1.067+1.044+1.022+1.000+1.000+1.000+1.000+1.022+1.044+1.067)/10).

In the second print mode, the print elements of the eight groups 201 to 208 discharge the inks. Therefore, the discharge port deviation average Vd_ave in the second print mode is calculated to be 1.019 (=(1.022+1.000+1.000+1.000+1.000+1.022+1.044+1.067)/8).

In the third print mode, the print elements of the two groups 201 and 202 discharge the inks. Therefore, the discharge port deviation average Vd_ave in the third print mode is calculated to be 1.056 (=(1.044+1.067)/2).

In the fourth print mode, the print elements of the four groups 201 to 204 discharge the inks. Therefore, the discharge port deviation average Vd_ave in the fourth print mode is calculated to be 1.033 (=(1.000+1.022+1.044+1.067)/4).

Next, at step S36, the pulse shift number is acquired based on the discharge amount deviation Vd_ave with reference to the pulse shift table shown in FIG. 11. FIG. 11 defines the correspondence between the discharge amount deviations Vd_dev and the pulse shift numbers. In the embodiment, the discharge amount deviations Vd_dev shown in FIG. 11 are replaced with the discharge amount deviation averages Vd_ave to be applied.

For example, when the manufacturing error of the discharge ports occurs as shown in FIGS. 20 and 21, the discharge amount deviation average Vd_ave is calculated to be 1.027 in the first print mode, and thus the pulse shift number "−3" is acquired with reference to the pulse shift table shown in FIG. 11.

In the second print mode, the discharge port deviation average Vd_ave is calculated to be 1.019, and the pulse shift number "−1" is acquired with reference to the pulse shift table shown in FIG. 11.

In the third print mode, the discharge port deviation average Vd_ave is calculated to be 1.056, and the pulse shift number "−5" is acquired with reference to the pulse shift table shown in FIG. 11.

In the fourth print mode, the discharge port deviation average Vd_ave is calculated to be 1.033, the pulse shift number "−3" is acquired with reference to the pulse shift table shown in FIG. 11.

In this manner, according to the embodiment, varying pulse shift numbers can be acquired depending on the positions and the numbers of the print elements used for printing in the respective print modes.

At step S37, the driving pulse to be applied to the print elements is decided based on the driving pulse tentatively decided at step S32 and the pulse shift number acquired at step S36. More specifically, the driving pulse to be applied to the print elements is decided by increasing or decreasing the number for the driving pulse tentatively decided at step S32 by the pulse shift number acquired at step S36 as described above.

According to the foregoing configuration, even when a plurality of print modes different in the position and number of the used print elements is implemented, it is possible to perform printing with reduction in the deviation of discharge amount due to the manufacturing error of the discharge ports in varying degrees in the respective print modes.

In the embodiment, as in the first embodiment, the driving pulse table defining the correspondence between the temperatures and the driving pulses and the pulse shift table defining the correspondence between the discharge amount deviation averages Vd_ave and the pulse shift numbers are used. However, the embodiment may be carried out in any other mode. For example, as in the second embodiment, a two-dimensional pulse table defining the correspondence among the temperatures, the discharge amount deviation averages Vd_ave, and the driving pulses may be used.

(Fourth Embodiment)

In the first to third embodiments, the ratio of the actual discharge amount to the desired discharge amount (first ratio) is used as the discharge amount deviation Vd_dev.

In contrast to this, in the embodiment, the ratio of the discharge amount from the discharge ports in the discharge port array to the average of the discharge amounts from the discharge ports (second ratio) is used as the discharge amount deviation Vd_dev.

The same contents as those of the first to third embodiments will not be described.

In the embodiment, as in the third embodiment, the driving pulse to be applied to the print elements is decided according to the flowchart shown in FIG. 19.

However, in the acquisition of the discharge amount deviation Vd_dev at step S33, the ratio of the discharge amount from the discharge ports in the discharge port array to the average of the discharge amounts from the discharge ports (second ratio) is acquired as the discharge amount deviation Vd_dev.

In the embodiment, as in the first to third embodiment, the discharge amount deviation Vd_dev is determined by measuring the actual discharge amount after the manufacture of the print head and before the shipment of the print head. The determined discharge amount deviation Vd_dev is stored in advance in the EEPROM provided in the print head 9. Then, at step S13, the information stored in the EEPROM is read to acquire the discharge amount deviation Vd_dev.

When the same manufacturing error of the discharge port always occurs at the time of manufacture of the print heads, it is not necessarily required to store the discharge amount deviation Vd_dev for each of the print heads. For example, the discharge amount deviation Vd_dev determined in one print head may be stored in advance in the ROM 102 of the printing apparatus so that the information stored in the ROM 102 is read at step S13 to acquire the discharge amount deviation Vd_dev.

FIG. 22 is a diagram showing schematically the discharge amount deviations Vd_dev in the groups 201 to 210 acquired at step S33 when the manufacturing error as shown in FIG. 20 occurs, as an example of manufacturing error of the discharge ports.

First, when the manufacturing error as shown in FIG. 22 occurs, the average of the discharge amounts in the discharge port array is 4.62 (=(4.8+4.7+4.6+4.5+4.5+4.5+4.5+4.6+4.7+4.8)/10) ng.

Therefore, as seen from FIG. 22, the discharge amount deviation Vd_dev in the groups 201 and 210 is 1.039 (=4.8 ng/4.62 ng). The discharge amount deviation Vd_dev in the groups 202 and 209 is 1.017 (=4.7 ng/4.62 ng). The discharge amount deviation Vd_dev in the groups 203 and 208 is 0.996 (=4.6 ng/4.62 ng). The discharge amount deviation Vd_dev in the groups 204, 205, 206, and 207 is 0.974 (=4.5 ng/4.62 ng).

Figure 23:
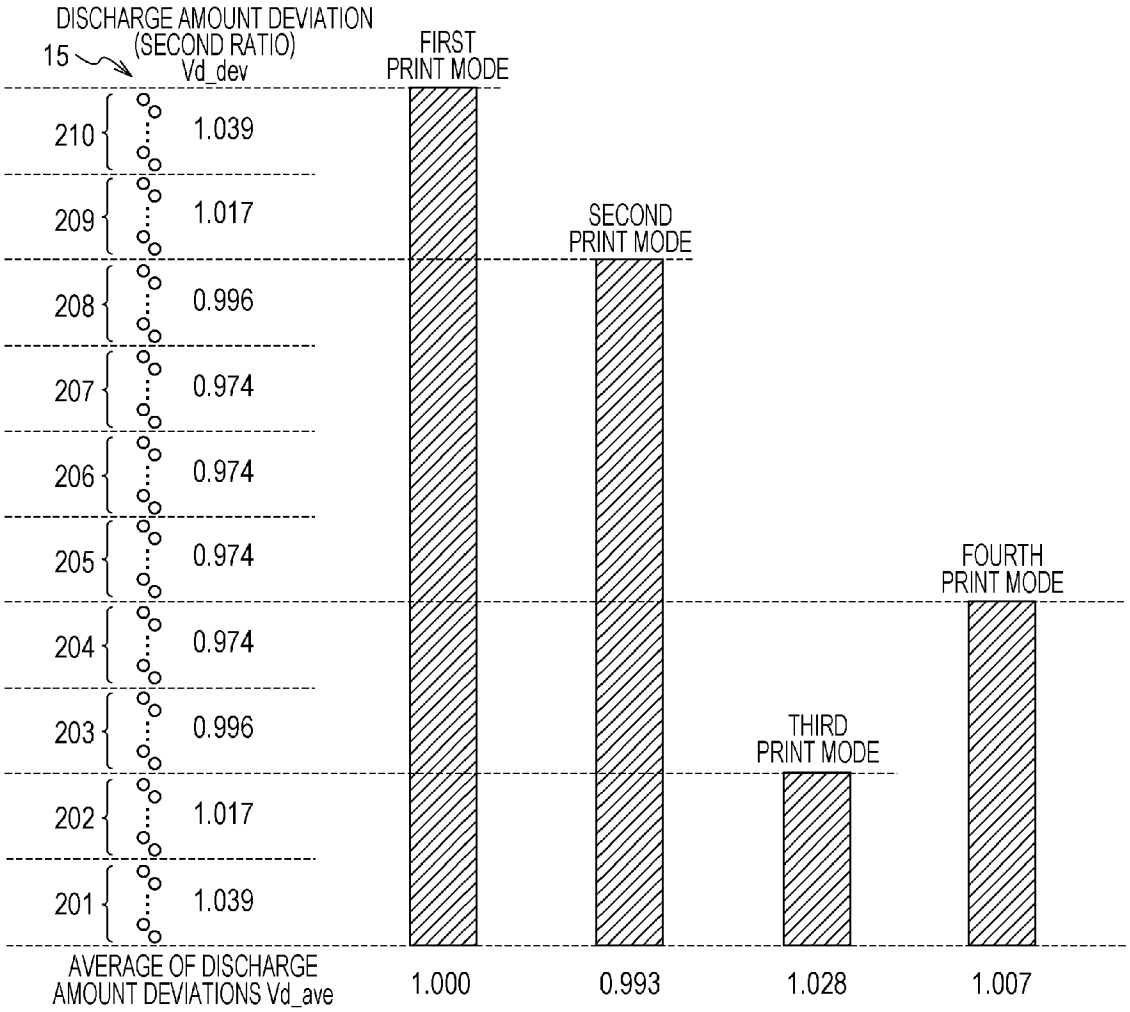
FIG. 23 is a schematic view for describing a method for calculating the average of deviations in the discharge amount.

FIG. 23 is a diagram schematically describing the discharge amount deviation averages Vd_ave in the first to fourth print modes acquired at step S35 in the embodiment when the manufacturing error as shown in FIG. 22 occurs.

In the first print mode, the print elements of the ten groups 201 to 210 discharge the inks as described above in relation to the third embodiment. Therefore, the discharge port deviation average Vd_ave in the first print mode is calculated to be 1.000 (=(1.039+1.017+0.996+0.974+0.974+0.974+0.974+0.996+1.017+1.039)/10).

In the second print mode, the print elements of the eight groups 201 to 208 discharge the inks as described above in relation to the third embodiment. Therefore, the discharge port deviation average Vd_ave in the second print mode is calculated to be 0.993 (=(0.996+0.974+0.974+0.974+0.974+0.996+1.017+1.039)/8).

In the third print mode, the print elements of the two groups 201 and 202 discharge the inks as described above in relation to the third embodiment. Therefore, the discharge port deviation average Vd_ave in the third print mode is calculated to be 1.028 (=(1.017+1.039)/2).

In the fourth print mode, the print elements of the four groups 201 to 204 discharge the inks as described above in relation to the third embodiment. Therefore, the discharge port deviation average Vd_ave in the fourth print mode is calculated to be 1.033 (=(0.974+0.996+1.017+1.039)/4).

Therefore, at step S36 in the embodiment, the discharge port deviation average Vd_ave is calculated to be 1.000 in the first print mode, and the pulse shift number "0" is acquired with reference to the pulse shift table shown in FIG. 11.

In the second print mode, the discharge port deviation average Vd_ave is calculated to be 0.993, and the pulse shift number "+1" is acquired with reference to the pulse shift table shown in FIG. 11.

In the third print mode, the discharge port deviation average Vd_ave is calculated to be 1.028, and the pulse shift number "−3" is acquired with reference to the pulse shift table shown in FIG. 11.

In the fourth print mode, the discharge port deviation average Vd_ave is calculated to be 1.007, and the pulse shift number "−1" is acquired with reference to the pulse shift table shown in FIG. 11.

According to the foregoing configuration, even when a plurality of print modes different in the position and number of the used print elements is implemented, it is possible to perform printing with reduction in the deviation of discharge amount due to the manufacturing error of the discharge ports in varying degrees in the respective print modes, as in the third embodiment.

In the embodiment, as in the first embodiment, the driving pulse table defining the correspondence between the temperatures and the driving pulses and the pulse shift table defining the correspondence between the discharge amount deviation averages Vd_ave and the pulse shift numbers are used. However, the embodiment may be carried out in any other mode. For example, as in the second embodiment, the two-dimensional driving pulse table defining the correspondence among the temperatures, the discharge amount deviation averages Vd_ave, and the driving pulses may be used.

(Fifth Embodiment)

In the first to fourth embodiments, the discharge amount deviation Vd_dev is stored in advance in the EEPROM in the print head or the ROM in the printing apparatus.

In contrast, in the embodiment, the discharge amount deviation Vd_dev is calculated at the user side after the shipment of the printing apparatus and the print head.

The same contents as those of the first to fourth embodiments will not be described.

Figure 24:
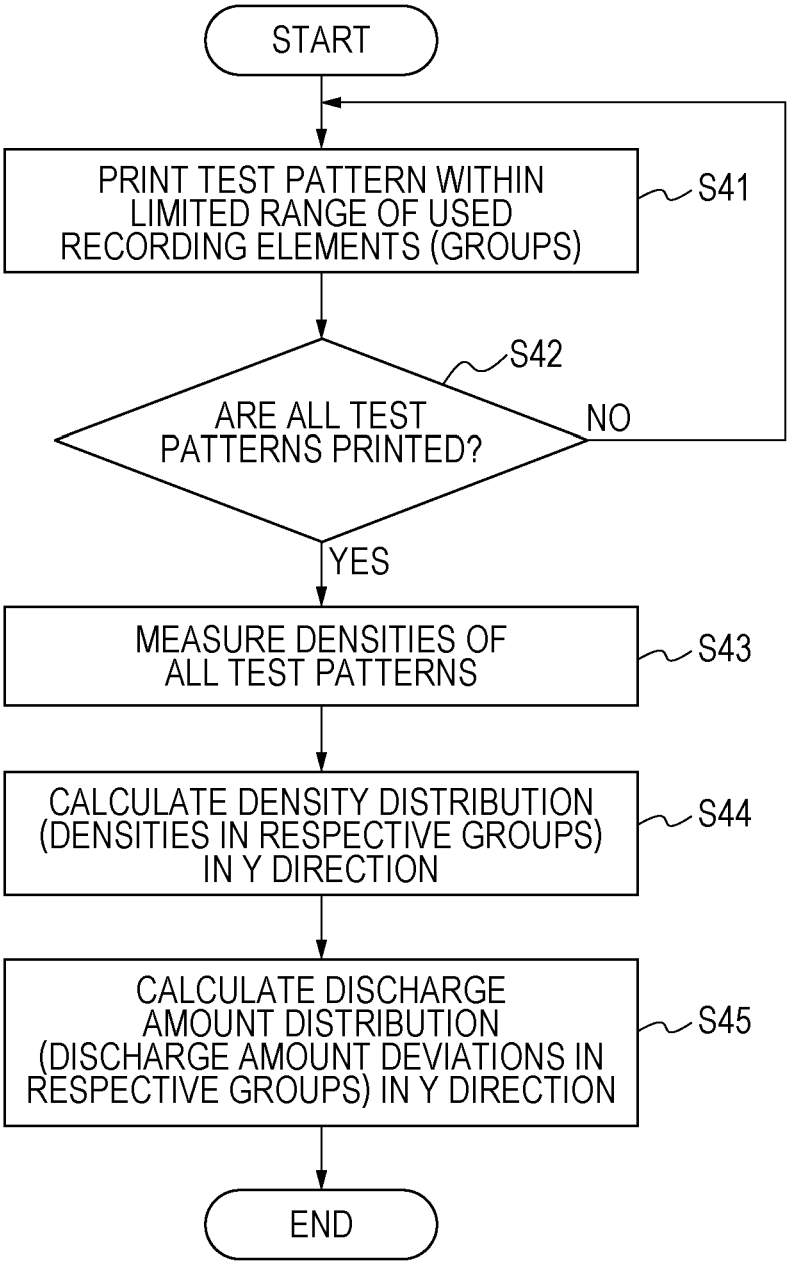
FIG. 24 is a flowchart of a method for measuring deviations in the discharge amount.
Figure 25:
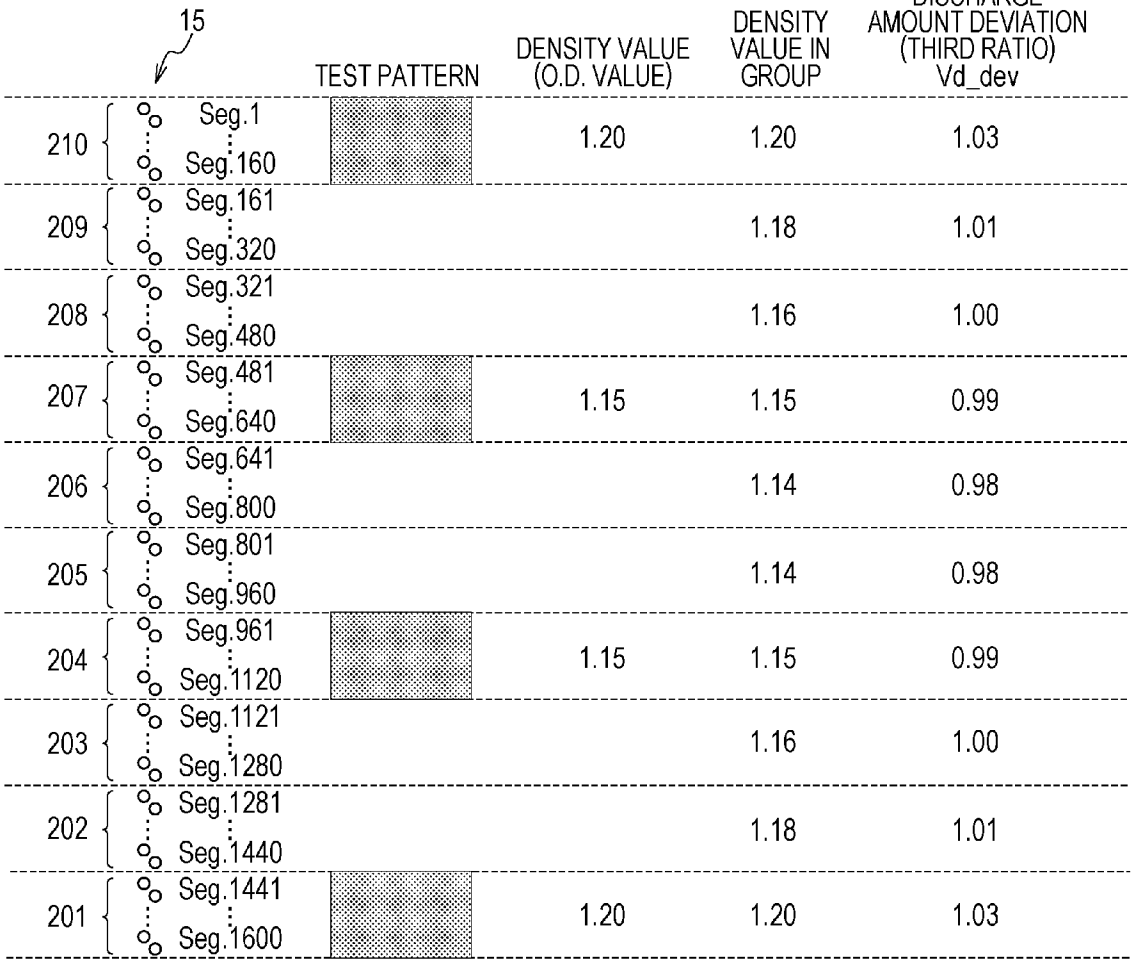
FIG. 25 is a schematic view of an example of deviations in the discharge amount.

FIG. 24 is a flowchart for calculating the discharge amount deviation Vd_dev executed by the CPU according to the control program in the embodiment. FIG. 25 is a schematic diagram for describing the process of the control for calculating the discharge amount deviation Vd_dev.

The control for calculating the discharge amount deviation Vd_dev shown in FIG. 24 is preferably executed when the print head is attached to the printing apparatus. Instead of the time of attachment of the print head, the control for calculating the discharge amount deviation Vd_dev may be executed on a regular basis.

First, at step S41, some of the print elements in the print element array discharge the inks to print test patterns for density measurement. In the embodiment, one of the ten groups 201 to 210 shown in FIGS. 15 to 18 discharges the inks.

At step S42, it is determined whether all of test patterns to be printed are completely printed. When it is determined that there is any test pattern yet to be printed, the process returns to step S41 to print one of the test patterns yet to be printed.

In the embodiment, the four groups 201, 204, 207, and 210 out of the ten groups print the test patterns. Therefore, after execution of steps S41 and S42, the four test patterns are printed as schematically shown in FIG. 25.

In this example, the four of the ten groups print the test patterns. However, the number of the groups printing the test patterns may be different as appropriate. For example, all the ten groups may print the test patterns. However, it is preferred that three or more test patterns are printed at almost regular intervals in the Y direction.

The test patterns to be printed are desirably uniform in density. In the example, the test patterns have a print duty of 100%.

Next, at step S43, optical density values (O.D. values) of the test patterns are measured by a density sensor (not illustrated) provided in the printing apparatus. FIG. 25 shows schematically the case in which, as examples of the measured density values, the density value of the test pattern corresponding to the group 201 is 1.20, the density value of the test pattern corresponding to the group 204 is 1.15, the density value of the test pattern corresponding to the group 207 is 1.15, and the density value of the test pattern corresponding to the group 210 is 1.20.

Next, at step S44, the density values of the groups 201 to 210 are calculated based on the density values measured at step S43. In the embodiment, an approximate curve is generated by a polynomial for the four measured density values and the density values of the four groups are interpolated. As shown in FIG. 25, when the four density values are measured, the four measured density values are approximated by a quadratic polynomial and expressed in (Equation 1) as follows:

$$Y=0.0028*X^2-0.0306*X+1.2278 \quad \text{(Equation 1)}$$

In the equation, X denotes the area number, which is 2 in the group 202, 3 in the group 203, 5 in the group 205, 6 in the group 206, 8 in the group 208, and 9 in the group 209, and Y denotes the density value in each of the groups.

According to (Equation 1), the density values in the groups other than 201, 204, 207, and 210 in which the density values were directly measured are calculated to be 1.18 in the group 202, 1.16 in the group 203, 1.14 in the group 205, 1.14 in the group 206, 1.16 in the group 208, and 1.18 in the group 209.

Next, at step S45, the ratios of the density values in the ten groups to the average of the density values in the ten groups (hereinafter, also referred to as third ratios) are determined as the discharge amount deviations Vd_dev.

As shown in FIG. 25, when the density values in the respective groups are calculated, the average of the density values is 1.167 (=(1.20+1.18+1.16+1.15+1.14+1.14+1.15+1.16+1.18+1.20)/10).

Therefore, the discharge amount deviations Vd_dev in the respective groups are calculated to be 1.03 (=1.20/1.167) in the group 201, 1.01 (=1.18/1.167) in the group 202, 1.00 (=1.16/1.167) in the group 203, 0.99 (=1.15/1.167) in the group 204, 0.98 (=1.14/1.167) in the group 205, 0.98 in the group 206, 0.99 in the group 207, 1.00 in the group 208, 1.01 in the group 209, and 1.03 in the group 210.

The subsequent process is performed in the same manner as the first to fourth embodiments, and descriptions thereof will be omitted.

As described above, in the embodiment, the printing apparatus can calculate by itself the discharge amount deviations Vd_dev. This makes it possible to achieve further higher image quality with consideration given to time-elapsed deterioration of the print head and environmental impact.

Other Embodiments

Embodiment(s) of the present invention can also be realized by a computer of a system or apparatus that reads out and executes computer executable instructions (e.g., one or more programs) printed on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the embodiments described above, image printing is performed by scanning the printing medium a plurality of times. However, image printing may be performed in any other manner. For example, the driving pulse controls of the embodiments are applicable to a printing apparatus in which a print head longer than the printing medium in the width direction is used to print the image such that the print head discharges the inks while the printing medium is conveyed only once in the direction intersecting with the width direction.

In the embodiments described above, the driving pulse table and the pulse shift table are used to decide the driving pulse to be applied to the print elements, or the two-dimensional driving pulse table is used to decide the driving pulse to be applied to the print elements. Additional processes may be performed before the decision of the driving pulse. For example, besides the processes in the foregoing embodiments, a process for modulating the pulse width to adjust discharge energy and a process for changing the driving pulse generating possibly minute foams (pre-foams) at the time of application of the pre-pulse to another one may be performed, for example.

In the embodiments described above, the first to third ratios are used as the discharge amount deviations Vd_dev. Instead of these ratios, differences or the like may be acquired as the discharge amount deviations Vd_dev.

In the third and fourth embodiments, the four print modes different in the number and position of the used print elements are implemented. However, the present invention is applicable to other printing apparatuses capable of implementing two or more printing modes.

According to the inkjet printing apparatus and the inkjet printing method of the present invention, it is possible to perform printing with suppressed image quality deterioration even in the event of the deviation of the discharge amount resulting from the manufacturing error of the discharge ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110378, filed May 29, 2015, which is hereby incorporated by reference herein in its entirety.

What is claimed is:

1. An inkjet printing apparatus, comprising:

a print head that has a print element array in which a plurality of print elements is arranged in a predetermined direction, the print elements generating energy for discharging inks with application of a driving pulse;

a first acquisition unit configured to acquire first information about a deviation of discharge amount of ink discharged by the plurality of print elements in the print element array;

a second acquisition unit configured to acquire second information about a temperature of the print head during print operation;

a decision unit configured to decide a first driving pulse based on the first information and the second information, the first driving pulse being composed of a main pulse and a pre-pulse applied to the print elements prior to the main pulse; and a control unit configured to control the print head so as to discharge the inks onto a printing medium by applying the first driving pulse to the print elements, wherein the decision unit decides the first driving pulse such that (i) when the deviation indicated by the first information is a first value and the temperature indicated by the second information is a first temperature, the pulse width of the pre-pulse of the first driving pulse is a first width, and (ii) when the deviation indicated by the first information is a second value larger than the first value and the temperature indicated by the second information is the first temperature, the pulse width of the pre-pulse of the first driving pulse is a second width shorter than the first width.

2. The inkjet printing apparatus according to claim 1, further comprising a memory configured to store a driving pulse table defining correspondence between a plurality of driving pulses and the temperature, the plurality of driving pulses being composed of a main pulse and a pre-pulse applied to the print elements prior to the main pulse and being different in the pulse width of the pre-pulse, wherein the decision unit includes:

a first decisions unit configured to decide a second driving pulse based on the second information and the driving pulse table;

a second decision unit configured to decide a pulse shift number based on the first information; and a third decisions unit configured to decide the first driving pulse by correcting the second driving pulse based on the pulse shift number.

3. The inkjet printing apparatus according to claim 2, wherein (i) when the deviation indicated by the first information is the first value, the pulse shift number is a first number, and (ii) when the deviation indicated by the first information is the second value, the pulse shift number is a second number smaller than the first number.

4. The inkjet printing apparatus according to claim 2, wherein the first decision unit decides the second driving pulse such that (i) when the temperature indicated by the second information is the first temperature, the pulse width of the pre-pulse of the second driving pulse is a third width, and (ii) when the temperature indicated by the second information is a second temperature higher than the first temperature, the pulse width of the pre-pulse of the second driving pulse is a fourth width shorter than the third width.

5. The inkjet printing apparatus according to claim 1, further comprising a memory configured to store a driving pulse table defining the correspondence among a plurality of driving pulses, the temperature and the deviation, the plurality of driving pulses being composed of a main pulse and a pre-pulse applied to the print elements prior to the main pulse and being different in the pulse width of the pre-pulse, wherein the decision unit decides the first driving pulse based on the first information, the second information, and the driving pulse table.

6. The inkjet printing apparatus according to claim 1, further comprising a selection unit configured to select one of a plurality of print modes at least including a first print mode in which printing is performed by driving a plurality of first print elements out of the plurality of print elements and a second print mode in which printing is performed by driving a plurality of second print elements out of the plurality of print elements, the second print elements being different in position in the predetermined direction and number from the plurality of first print elements, wherein (i) when the selection unit selects the first print mode, the first acquisition unit acquires information about a deviation of the discharge amount of ink discharged by the plurality of first print elements as the first information, and (ii) when the selection unit selects the second print mode, the first acquisition unit acquires information about a deviation of the discharge amount of ink discharged by the plurality of second print elements as the first information, and the control unit controls the print head in accordance with the print mode selected by the selection unit.

7. The inkjet printing apparatus according to claim 1, wherein the first acquisition unit acquires the ratio of the discharge amount in one of a plurality of print element groups formed by dividing the plurality of print elements in the predetermined direction to the average of the discharge amounts of ink discharged by the plurality of print element groups, as the first information about the deviation of the discharge amount in the print element group.

8. The inkjet printing apparatus according to claim 1, wherein the first acquisition unit acquires the ratio of the actual discharge amount of ink discharged by the print elements to a pre-decided reference value of the discharge amount of ink discharged by the print elements, as the first information about the deviation of the discharge amount of ink discharged by the print elements.

9. The inkjet printing apparatus according to claim 1, wherein the decision unit decides the first driving pulse at predetermined time intervals during print operation.

10. The inkjet printing apparatus according to claim 1, wherein the decision unit decides the first driving pulse such that deviation indicated by the first information is the first value, the temperature indicated by the second information is a second temperature higher than the first temperature, and the pulse width of the pre-pulse of the first driving pulse is a third width shorter than the first width.

11. An inkjet printing method for performing printing with the use of a print head configured to have a print element array in which a plurality of print elements is arranged in a predetermined direction, the print elements generating energy for discharging inks with application of a driving pulse, comprising:

a first acquisition step of acquiring first information about a deviation of discharge amount of ink discharged by the plurality of print elements in the print element array;

a second acquisition step of acquiring second information about the temperature of the print head during print operation;

a decision step of deciding a first driving pulse based on the first information and the second information; and a control step of controlling the print head so as to discharge the inks onto a printing medium by applying the first driving pulse to the print elements, wherein the decision step decides the first driving pulse such that (i) when the deviation indicated by the first information is a first value and the temperature indicated by the second information is a first temperature, the pulse width of the pre-pulse of the first driving pulse is a first width, and (ii) when the deviation indicated by the first information is a second value larger than the first value and the temperature indicated by the second information is the first temperature, the pulse width of the pre-pulse of the first driving pulse is a second width shorter than the first width.

12. An inkjet printing apparatus, comprising:

a print head that has a print element array in which a plurality of print elements is arranged in a predetermined direction, the print elements generating energy for discharging inks with application of a driving pulse;

a selection unit configured to select one of a plurality of print modes at least including a first print mode in which printing is performed by driving a plurality of first print elements out of the plurality of print elements and a second print mode in which printing is performed by driving a plurality of second print elements out of the plurality of print elements, the second print elements being different in position in the predetermined direction and number from the plurality of first print elements;

a first acquisition unit configured to acquire first information about the deviation of the discharge amount of ink discharged by the plurality of print elements in the print element array;

a second acquisition unit configured to acquire second information about the temperature of the print head during print operation;

a decision unit configured to decide a first driving pulse based on the first information and the second information; and a control unit configured to control the print head so as to discharge the inks onto a printing medium by applying the first driving pulse to the print elements, in accordance with the print mode selected by the selection unit, wherein (i) when the selection unit selects the first print mode, the first acquisition unit acquires information about a deviation of the discharge amount of ink discharged by the plurality of first print elements as the first information, and (ii) when the selection unit selects the second print mode, the first acquisition unit acquires information about a deviation of the discharge amount of ink discharged by the plurality of second print elements as the first information.

* * * * *